US007091668B2

(12) United States Patent
Yahagi et al.

(10) Patent No.: US 7,091,668 B2
(45) Date of Patent: Aug. 15, 2006

(54) DISPLAY AND DISPLAY PANEL DRIVING METHOD

(75) Inventors: Kazuo Yahagi, Yamanashi-ken (JP); Mitsushi Kitagawa, Fukuroi (JP); Nobuhiko Saegusa, Yamanashi-ken (JP); Shigeru Iwaoka, Yamanashi-ken (JP); Tsutomu Tokunaga, Yamanashi-ken (JP); Ryo Suzue, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 462 days.

(21) Appl. No.: 10/677,258

(22) Filed: Oct. 3, 2003

(65) Prior Publication Data

US 2004/0104685 A1 Jun. 3, 2004

(30) Foreign Application Priority Data

Oct. 4, 2002 (JP) ..... 2002-292850

(51) Int. Cl.
*G09G 3/10* (2006.01)

(52) U.S. Cl. ..... 315/169.2; 313/584; 345/67; 345/41

(58) Field of Classification Search ..... 345/30, 345/41, 67, 690, 204; 315/169.1–169.4; 313/584

See application file for complete search history.

(56) References Cited

U.S. PATENT DOCUMENTS 6,603,263 B1 * 8/2003 Hashimoto et al. ..... 313/584
6,608,611 B1 * 8/2003 Lim ..... 345/67

FOREIGN PATENT DOCUMENTS

| | | | |
|---|---|---|---|
| CN | 1397979 | A | 2/2003 |
| CN | 1405829 | A | 3/2003 |
| JP | 11-297211 | A | 10/1999 |
| JP | 2001-154630 | A | 6/2001 |

* cited by examiner

*Primary Examiner*—Kent Chang
*Assistant Examiner*—Tammy Pham
(74) *Attorney, Agent, or Firm*—Sughrue Mion, PLLC

(57) ABSTRACT

A display and a driving method of a display panel capable of improving a dark contrast. In driving the display panel having light-emission areas formed at each intersection of a plurality of pairs of row electrodes and a plurality of column electrodes, each of the light-emission areas having a first discharge cell including a portion where the respective row electrodes in pair are opposed to each other with a predetermined discharge gap within a discharge space and a second discharge cell including a portion where a light absorptive layer is provided and one row electrode of the row electrode pair and the other row electrode of the row electrode pair adjacent to this row electrode pair are opposed to each other with a predetermined discharge gap, an address discharge is produced within the second discharge cell, to set the second discharge cell at a light-on state or a light-off state, by applying a pixel data pulse based on an input image signal, to respective column electrodes, while applying a scanning pulse to a row electrode having the longer distance to the first discharge cell, of the respective row electrodes within the second discharge cell. This structure causes the address discharge within the second discharge cell relatively distant from the first discharge cell, so that the amount of a ultraviolet ray by the address discharge flowing into the first discharge cell is reduced, to suppress the deterioration of the dark contrast.

29 Claims, 17 Drawing Sheets

FIG. 2 Prior Art

● : SELECTIVE - ERASE DISCHARGE
○ : LIGHT EMISSION SF

| GRADATION | CONVERSION TABLE | | | | | | | | | | | | | LIGHT EMISSION DRIVE PATTERN | | | | | | | | | | | | DISPLAY BRIGHTNESS |
|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 | |
| 1 | 0000 | 1 | 0 | 0 | 0 | 0 | 0 | 0 | 0 | 0 | 0 | 0 | 0 | ● | | | | | | | | | | | | 0 |
| 2 | 0001 | 0 | 1 | 0 | 0 | 0 | 0 | 0 | 0 | 0 | 0 | 0 | 0 | ○ | ● | | | | | | | | | | | 1 |
| 3 | 0010 | 0 | 0 | 1 | 0 | 0 | 0 | 0 | 0 | 0 | 0 | 0 | 0 | ○ | ○ | ● | | | | | | | | | | 3 |
| 4 | 0011 | 0 | 0 | 0 | 1 | 0 | 0 | 0 | 0 | 0 | 0 | 0 | 0 | ○ | ○ | ○ | ● | | | | | | | | | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 14 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 25 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 39 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 59 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 84 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 117 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 157 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 205 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 |

FIG. 9

| GRADATION DRIVE | CONVERSION TABLE | | | | | | | | | | | | | | | | LIGHT EMISSION PATTERN | | | | | | | | | | | | | | | |
|---|---|---|---|---|---|---|---|---|---|---|---|---|---|---|---|---|---|---|---|---|---|---|---|---|---|---|---|---|---|---|---|---|
| | PDs | GD | | | | | | | | | | | | | | | SF | SF | SF | SF | SF | SF | SF | SF | SF | SF | SF | SF | SF | SF | SF | SF |
| | | 1 | 2 | 3 | 4 | 5 | 6 | 7 | 8 | 9 | 10 | 11 | 12 | 13 | 14 | 15 | 1 | 2 | 3 | 4 | 5 | 6 | 7 | 8 | 9 | 10 | 11 | 12 | 13 | 14 | 15 |
| FIRST | 0000 | 0 | 0 | 0 | 0 | 0 | 0 | 0 | 0 | 0 | 0 | 0 | 0 | 0 | 0 | 0 | | | | | | | | | | | | | | | | |
| SECOND | 0001 | 1 | 0 | 0 | 0 | 0 | 0 | 0 | 0 | 0 | 0 | 0 | 0 | 0 | 0 | 0 | ◎ | | | | | | | | | | | | | | | |
| THIRD | 0010 | 1 | 1 | 0 | 0 | 0 | 0 | 0 | 0 | 0 | 0 | 0 | 0 | 0 | 0 | 0 | ◎ | ◎ | | | | | | | | | | | | | | |
| FOURTH | 0011 | 1 | 1 | 1 | 0 | 0 | 0 | 0 | 0 | 0 | 0 | 0 | 0 | 0 | 0 | 0 | ◎ | ◎ | ◎ | | | | | | | | | | | | | |
| FIFTH | 0100 | 1 | 1 | 1 | 1 | 0 | 0 | 0 | 0 | 0 | 0 | 0 | 0 | 0 | 0 | 0 | ◎ | ◎ | ◎ | ◎ | | | | | | | | | | | | |
| SIXTH | 0101 | 1 | 1 | 1 | 1 | 1 | 0 | 0 | 0 | 0 | 0 | 0 | 0 | 0 | 0 | 0 | ◎ | ◎ | ◎ | ◎ | ◎ | | | | | | | | | | | |
| SEVENTH | 0110 | 1 | 1 | 1 | 1 | 1 | 1 | 0 | 0 | 0 | 0 | 0 | 0 | 0 | 0 | 0 | ◎ | ◎ | ◎ | ◎ | ◎ | ◎ | | | | | | | | | | |
| EIGHTH | 0111 | 1 | 1 | 1 | 1 | 1 | 1 | 1 | 0 | 0 | 0 | 0 | 0 | 0 | 0 | 0 | ◎ | ◎ | ◎ | ◎ | ◎ | ◎ | ◎ | | | | | | | | | |
| NINTH | 1000 | 1 | 1 | 1 | 1 | 1 | 1 | 1 | 1 | 0 | 0 | 0 | 0 | 0 | 0 | 0 | ◎ | ◎ | ◎ | ◎ | ◎ | ◎ | ◎ | ◎ | | | | | | | | |
| TENTH | 1001 | 1 | 1 | 1 | 1 | 1 | 1 | 1 | 1 | 1 | 0 | 0 | 0 | 0 | 0 | 0 | ◎ | ◎ | ◎ | ◎ | ◎ | ◎ | ◎ | ◎ | ◎ | | | | | | | |
| ELEVENTH | 1010 | 1 | 1 | 1 | 1 | 1 | 1 | 1 | 1 | 1 | 1 | 0 | 0 | 0 | 0 | 0 | ◎ | ◎ | ◎ | ◎ | ◎ | ◎ | ◎ | ◎ | ◎ | ◎ | | | | | | |
| TWELFTH | 1011 | 1 | 1 | 1 | 1 | 1 | 1 | 1 | 1 | 1 | 1 | 1 | 0 | 0 | 0 | 0 | ◎ | ◎ | ◎ | ◎ | ◎ | ◎ | ◎ | ◎ | ◎ | ◎ | ◎ | | | | | |
| THIRTEENTH | 1100 | 1 | 1 | 1 | 1 | 1 | 1 | 1 | 1 | 1 | 1 | 1 | 1 | 0 | 0 | 0 | ◎ | ◎ | ◎ | ◎ | ◎ | ◎ | ◎ | ◎ | ◎ | ◎ | ◎ | ◎ | | | | |
| FOURTEENTH | 1101 | 1 | 1 | 1 | 1 | 1 | 1 | 1 | 1 | 1 | 1 | 1 | 1 | 1 | 0 | 0 | ◎ | ◎ | ◎ | ◎ | ◎ | ◎ | ◎ | ◎ | ◎ | ◎ | ◎ | ◎ | ◎ | | | |
| FIFTEENTH | 1110 | 1 | 1 | 1 | 1 | 1 | 1 | 1 | 1 | 1 | 1 | 1 | 1 | 1 | 1 | 0 | ◎ | ◎ | ◎ | ◎ | ◎ | ◎ | ◎ | ◎ | ◎ | ◎ | ◎ | ◎ | ◎ | ◎ | | |
| SIXTEENTH | 1111 | 1 | 1 | 1 | 1 | 1 | 1 | 1 | 1 | 1 | 1 | 1 | 1 | 1 | 1 | 1 | ◎ | ◎ | ◎ | ◎ | ◎ | ◎ | ◎ | ◎ | ◎ | ◎ | ◎ | ◎ | ◎ | ◎ | ◎ | ◎ |

◎ : WRITING ADDRESS DISCHARGE + SUSUTAIN DISCHARGE LIGHT EMISSION

FIG. 13

| GRADATION DRIVE | CONVERSION TABLE | | | | | | | | | | | | | | | | LIGHT EMISSING PATTERN | | | | | | | | | | | | | | |
|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | 15 | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 |
| FIRST | 0000 | 1 | 0 | 0 | 0 | 0 | 0 | 0 | 0 | 0 | 0 | 0 | 0 | 0 | 0 | 0 | ● | | | | | | | | | | | | | | |
| SECOND | 0001 | 0 | 1 | 0 | 0 | 0 | 0 | 0 | 0 | 0 | 0 | 0 | 0 | 0 | 0 | 0 | ○ | ● | | | | | | | | | | | | | |
| THIRD | 0010 | 0 | 0 | 1 | 0 | 0 | 0 | 0 | 0 | 0 | 0 | 0 | 0 | 0 | 0 | 0 | ○ | ○ | ● | | | | | | | | | | | | |
| FOURTH | 0011 | 0 | 0 | 0 | 1 | 0 | 0 | 0 | 0 | 0 | 0 | 0 | 0 | 0 | 0 | 0 | ○ | ○ | ○ | ● | | | | | | | | | | | |
| FIFTH | 0100 | 0 | 0 | 0 | 0 | 1 | 0 | 0 | 0 | 0 | 0 | 0 | 0 | 0 | 0 | 0 | ○ | ○ | ○ | ○ | ● | | | | | | | | | | |
| SIXTH | 0101 | 0 | 0 | 0 | 0 | 0 | 1 | 0 | 0 | 0 | 0 | 0 | 0 | 0 | 0 | 0 | ○ | ○ | ○ | ○ | ○ | ● | | | | | | | | | |
| SEVENTH | 0110 | 0 | 0 | 0 | 0 | 0 | 0 | 1 | 0 | 0 | 0 | 0 | 0 | 0 | 0 | 0 | ○ | ○ | ○ | ○ | ○ | ○ | ● | | | | | | | | |
| EIGHTH | 0111 | 0 | 0 | 0 | 0 | 0 | 0 | 0 | 1 | 0 | 0 | 0 | 0 | 0 | 0 | 0 | ○ | ○ | ○ | ○ | ○ | ○ | ○ | ● | | | | | | | |
| NINTH | 1000 | 0 | 0 | 0 | 0 | 0 | 0 | 0 | 0 | 1 | 0 | 0 | 0 | 0 | 0 | 0 | ○ | ○ | ○ | ○ | ○ | ○ | ○ | ○ | ● | | | | | | |
| TENTH | 1001 | 0 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ○ | ● | | | | | |
| ELEVENTH | 1010 | 0 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ○ | ● | | | | |
| TWELFTH | 1011 | 0 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ○ | ● | | | |
| THIRTEENTH | 1100 | 0 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ○ | ● | | |
| FOURTEENTH | 1101 | 0 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ○ | ● | |
| FIFTEENTH | 1110 | 0 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ○ | ● |
| SIXTEENTH | 1111 | 0 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ |

● : ERASE ADDRESS DISCHARGE ○ : SUSTAIN DISCHARGE LIGHT EMISSION

DISPLAY AND DISPLAY PANEL DRIVING METHOD

BACKGROUND OF THE INVENTION

1. Field of the Invention

The present invention relates to a display having a display panel mounted there and a driving method of the display panel.

2. Description of the Related Art

Recently, a plasma display panel (hereafter, referred to as PDP) with a plurality of discharge cells arranged in matrix gains attention as a two-dimensional image display panel. The PDP is directly driven by a digital image signal and the number of the displayable brightness gradation is determined by the number of the bits of the pixel data for every pixel based on the digital image signal.

Subfield method is known as a gradation display method of the PDP. The subfield method features division of a display period into a plurality of sub-periods to drive each cell. In the subfield method, the display period of one field is divided into a plurality of subfields so to perform the light-emission drive on the PDP in every subfield. Each subfield includes an address period of setting a light-on mode or a light-off mode of each pixel depending on the pixel data and a light emission sustaining period for lighting on (emitting light) only the pixel in the light-on mode, for the period corresponding to the weight of the subfield. Namely, whether the discharge cell should emit light or not in each subfield is set in every subfield (address period), and only the discharge cell set at the light-on mode is made to emit light for only the period assigned to the subfield (light emission sustaining period). Thus, there occurs the case where a subfield in a light emitting state and a subfield in a light-off (non-light emitting) state exist in a mixed way, hence to visualize the intermediate gradation depending on the total sum of the light-emission periods of the respective subfields within one field.

FIG. 1 schematically shows an example of a light emission drive format of the PDP. For example, refer to FIG. 6 to FIG. 8 of Japanese Patent Kokai No. 2001-154630 (patent document 1).

Namely, one field in an image signal is divided into twelve subfields of SF1 to SF12 and the drive of the PDP is performed in each subfield. In this process, each subfield is formed by an address stage Wc for setting each discharge cell of the PDP at "light-on state" (namely, operative mode) according to an input image signal and "light-off state" (namely, non-operative mode) and a sustain stage Ic for making only the discharge cell in the "light-on state" emit light only for the period (the number of times) corresponding to the weight of each subfield. Here, a simultaneous reset stage Rc for initializing all the discharge cells of the PDP into the "light-on state" is executed only in the head subfield SF1, and an erase stage E is executed only in the last subfield SF12.

FIG. 2 shows pixel drive data GD obtained by performing the following conversion processing on the pixel data and its corresponding gradation and light-emission drive pattern of a discharge cell (for example, refer to the patent document 1).

By sampling an image signal, for example, the pixel data for 8 bits can be obtained. The obtained pixel data is subjected to the multiple gradation processing and while keeping the current number of gradation levels, the number of the bits is reduced to 4 bits hence to generate the multiple gradation-processed pixel data $PD_s$. The multiple gradation-processed pixel data $PD_s$ is converted into the pixel drive data GD consisting of first to twelfth bits, according to a conversion table, as shown in FIG. 2. Each of these first and twelfth bits corresponds to each of the above-mentioned subfields SF1 to SF12.

FIG. 3 is a view showing the applying timings of various drive pulse to be applied to the row electrodes and the column electrodes of the PDP, according to the light-emission drive format shown in FIG. 2 (for example, refer to the patent document 1). FIG. 3 shows the case of the driving according to a selective-erasing method (one-reset one-select-erase address method).

In the simultaneous reset stage Rc of the subfield SF1, at first, the reset pulse $RP_x$ of negative polarity is applied to the row electrodes $X_1$ to $X_n$. Simultaneously with the application of the reset pulse $RP_x$, the reset pulse $RP_Y$ of positive polarity is applied to the row electrodes $Y_1$ to $Y_2$. According to the application of the reset pulses $RP_x$ and $RP_y$, all the discharge cells are discharged and reset, and each wall charge of the same predetermined amount is formed within each discharge cell. Thus, all the discharge cells are initialized into the "light-on state".

In the address stage Wc of each subfield, pixel data pulses DP each having a voltage corresponding to a logical level of the pixel drive data bits DB1 to DB12. The pixel drive data bits DB1 to DB12 correspond to the first to the twelfth bits of the pixel drive data GD. For example, in the address stage Wc of the subfield SF1, at first, the pixel drive data bit DB1 is converted into a pixel data pulse having a voltage corresponding to its logical level. The number m of the pixel data pulses corresponding to the first line is defined as the pixel data pulse group $DP1_1$, the number m of the pixel data pulses corresponding to the second line is defined as the pixel data pulse group $DP1_2$, the number m of the pixel data pulses corresponding to the n-th line is defined as the pixel data pulse group $DP1_n$, and each of the pixel data pulse groups $DP1_1$ to $DP1_n$ is sequentially applied to the column electrodes $D_1$ to $D_m$.

Further, in the address stage Wc, at the same timing as each applying timing of the pixel data pulse group DP as mentioned above, a scanning pulse SP of negative polarity is sequentially applied to the column electrodes $Y_1$ to $Y_n$. In this process, only the discharge cell at an intersection of the row electrode having the scanning pulse SP applied and the column electrode having the pixel data pulse of high pressure applied, is discharged (selective-erase discharge) and the wall charge left within the discharge cell is selectively erased.

According to the selective-erase discharge, the discharge cell initialized into the "light-on state" in the simultaneous reset stage Rc is turned to the "light-off state". While, the discharge cell where the selective-erase discharge does not occur is maintained in the initialized state, namely in the "light-on state" in the simultaneous reset stage Rc.

In the sustain stage IC of the respective subfields, as illustrated in FIG. 3, respective sustain pulses $IP_X$ and $IP_Y$ of positive polarity are alternatively applied to the respective row electrodes $X_1$ to $X_n$ and $Y_1$ to $Y_n$. Here, in the sustain stage IC, the sustain pulse IP is applied in such a manner that the number of the sustain pulses IP may become a predetermined ratio in the respective subfields SF1 to SF12. For example, as shown in FIG. 1, the ratio of the number of the sustain pulses in the respective subfields becomes SF1:SF2:SF3:SF4:SF5:SF6:SF7:SF8:SF9:SF10:SF11:SF12=1:2:4:7:11:14:20:25:33:40:48:50.

In this case, only the discharge cell where the wall discharge is still left, namely the discharge cell set at the "light-on state" in the above address stage Wc, is sustained every time the sustain pulses $IP_X$ and $IP_Y$ are applied there. Accordingly, the discharge cell set at the "light-on state" sustains the light emission state accompanying the sustain discharge, for the number of the times assigned to each subfield as mentioned above.

The erase stage E is executed only in the last subfield SF12. In this erase stage E, an erase pulse AP of positive polarity is generated and applied to the respective column electrodes $D_1$ to $D_m$. Further, simultaneously with the applying timing of the erase pulse AP, the erase pulse EP of negative polarity is generated and applied to the respective row electrodes $Y_1$ to $Y_n$. The simultaneous application of these erase pulses AP and EP causes the erase discharge in all the discharge cells in the PDP and extinguishes the wall charges left within all the discharge cells. According to the erase discharge, all the discharge cells in the PDP are turned to the "light-off state".

In the drive method as mentioned above, only in one of the subfields, only the discharge cell in a light emission state in the proximate subfield is selectively erased in the address stage. Thus, starting from the head subfield, the number N (for example, 12) of the subfields are sequentially lit on, hence to display the N+1-level gradation (for example, 13-level gradation), and then, the gradation display depending on the brightness represented by an input image signal is realized according to the total sum of the sustain discharges in the respective subfields.

In the driving of the PDP, however, the reset discharge and the address discharge accompanied by the light emission not related to the display image should be generated, in addition to the sustain discharge serving for a display image. Accordingly, it has the defect of deteriorating the contrast of an image, especially, the dark contrast at a display time of an image indicating a dark scene.

In order to solve the above problem, an object of the present invention is to provide a display and a driving method of a display panel capable of improving the dark contrast.

SUMMARY OF THE INVENTION

A display according to the characteristic of the invention is the display for displaying an image according to pixel data of every pixel based on an input image signal, comprising: a display panel having a front substrate and a rear substrate arranged at opposite positions for interposing a discharge space therebetween; a plurality of pairs of row electrodes provided on an inner surface of the front substrate, a plurality of column electrodes arranged on an inner surface of the rear substrate in a way of intersecting with the pairs of row electrodes, and light-emission areas formed at each intersection of the row electrode pairs and the column electrodes, each of the light-emission areas consisting of a first discharge cell including a portion where the respective row electrodes in pair are opposed to each other with a first discharge gap in the discharge space and a second discharge cell including a portion where a light absorptive layer is provided on the front substrate's side and one row electrode of the row electrode pair and the other row electrode of the row electrode pair adjacent to the above row electrode pair are opposed to each other with a second discharge gap; and an address component for producing an address discharge within the second discharge cell selectively by applying a pixel data pulse based on the pixel data, to the respective column electrodes, while applying a scanning pulse to a row electrode having the longer distance to the first discharge cell, of the respective row electrodes within the second discharge cell, thereby setting the second discharge cell at a light-on state or a light-off state.

A driving method of a display panel according to the characteristic of the invention is the driving method for driving a display panel according to the pixel data of every pixel based on an input image signal, the display panel having: a front substrate and a rear substrate arranged at opposite positions for interposing a discharge space therebetween; a plurality of pairs of row electrodes provided on an inner surface of the front substrate; a plurality of column electrodes arranged on an inner surface of the rear substrate in a way of intersecting with the pairs of row electrodes; and light-emission areas formed at each intersection of the row electrode pairs and the column electrodes, each of the light-emission areas consisting of a first discharge cell including a portion where the respective row electrodes in pair are opposed to each other with a first discharge gap in the discharge space and a second discharge cell including a portion where a light absorptive layer is provided on the front substrate's side and one row electrode of the row electrode pair and the other row electrode of the row electrode pair adjacent to the above row electrode pair are opposed to each other with a second discharge gap, the method comprising: an address stage for producing an address discharge within the second discharge cell selectively by applying a pixel data pulse based on the pixel data, to the respective column electrodes, while applying a scanning pulse to a row electrode having the longer distance to the first discharge cell, of the respective row electrodes within the second discharge cell, thereby setting the second discharge cell at a light-on state or a light-off state; a priming expansion stage for expanding a discharge toward the first discharge cell to set the first discharge cell at a light-on state, by applying a priming pulse alternately to the respective row electrodes within the second discharge cell to cause a priming discharge only in the second discharge cell that is in the light-on state; and a sustain stage for repeatedly applying a sustain pulse alternately to the respective row electrodes within the first discharge cell to cause a sustain discharge only in the first discharge cell that is in the light-on state.

BRIEF DESCRIPTION OF THE DRAWINGS

FIG. 2 is a view showing pixel drive data GD obtained by a conversion table of the conventional pixel data and a light-emission drive pattern based on the pixel drive data GD.

FIG. 9 is a view showing the pixel drive data GD obtained by the pixel data conversion table in the plasma display shown in FIG. 4 and the light-emission drive pattern based on the above pixel drive data GD.

FIG. 13 is a view showing another example of the pixel drive data GD obtained by the pixel data conversion table in the plasma display shown in FIG. 4 and the light-emission drive pattern based on the pixel drive data GD.

DETAILED DESCRIPTION OF THE INVENTION

Figure 1:
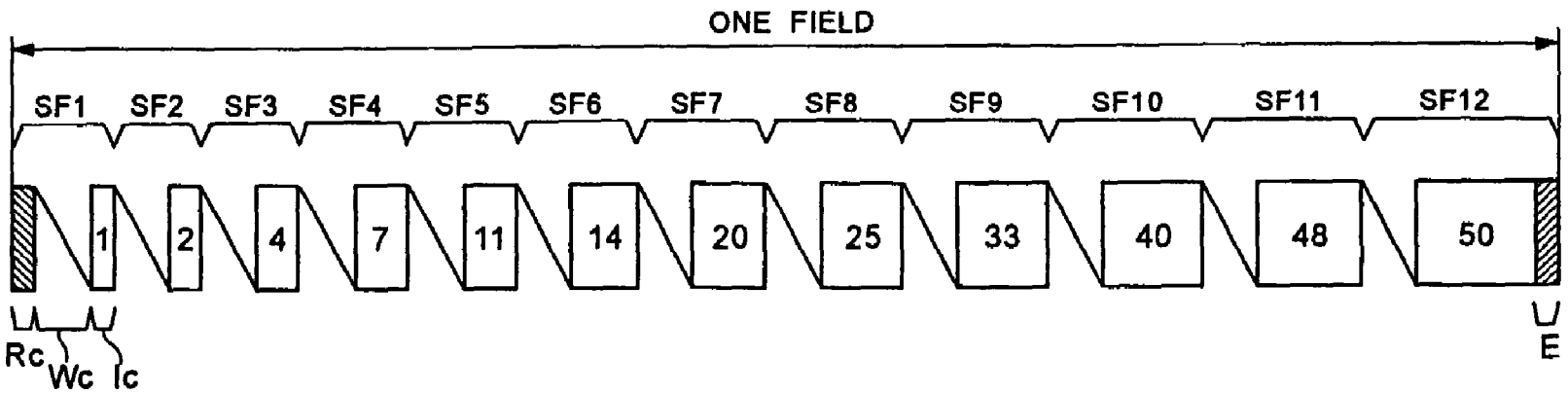
FIG. 1 Prior Art
FIG. 1 is a view showing an example of a light-emission drive format of the PDP based on the subfield method.
Figure 3:
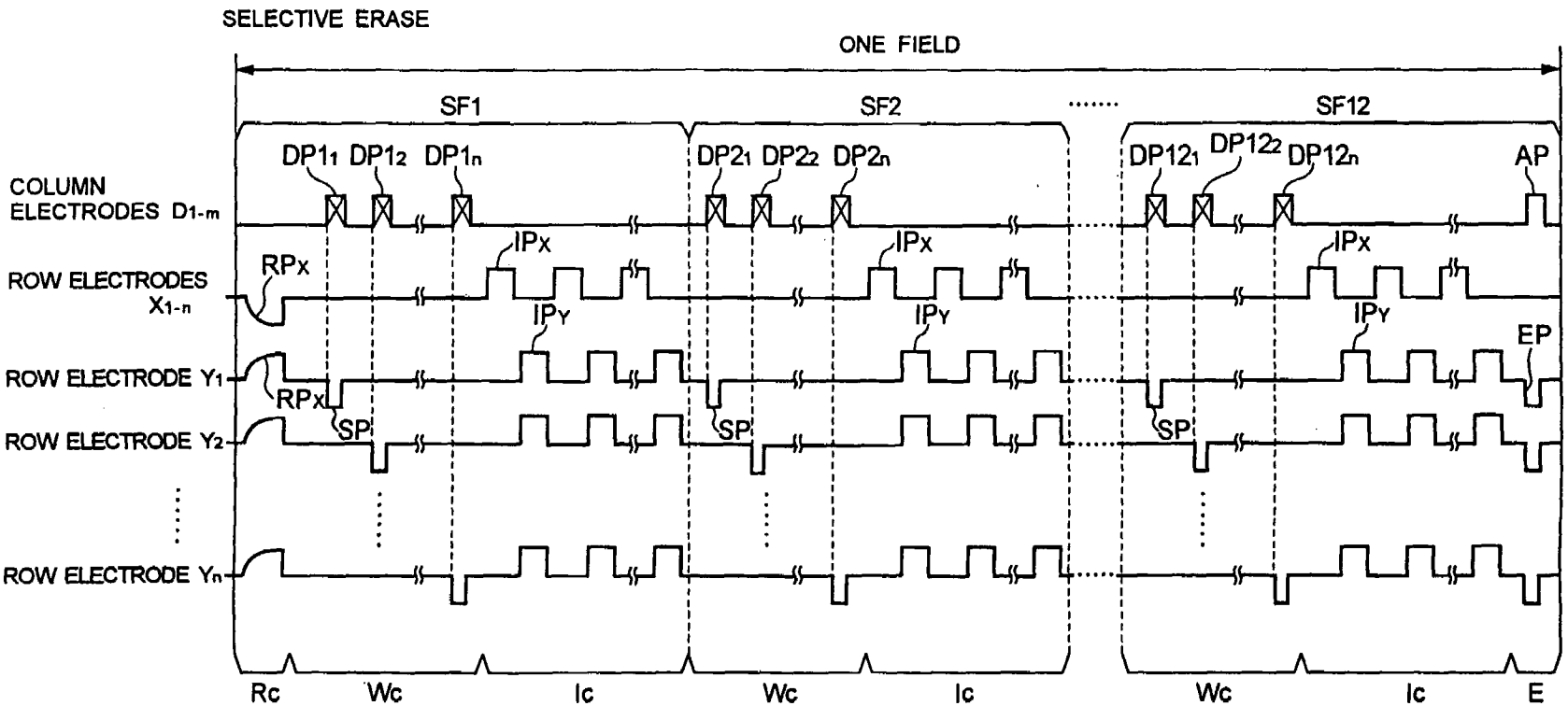
FIG. 3 Prior Art
FIG. 3 is a view showing the applying timing of various driving pulse to be applied to the row electrodes and the column electrodes of the PDP, according to the light-emission drive format shown in FIG. 1.
Figure 4:
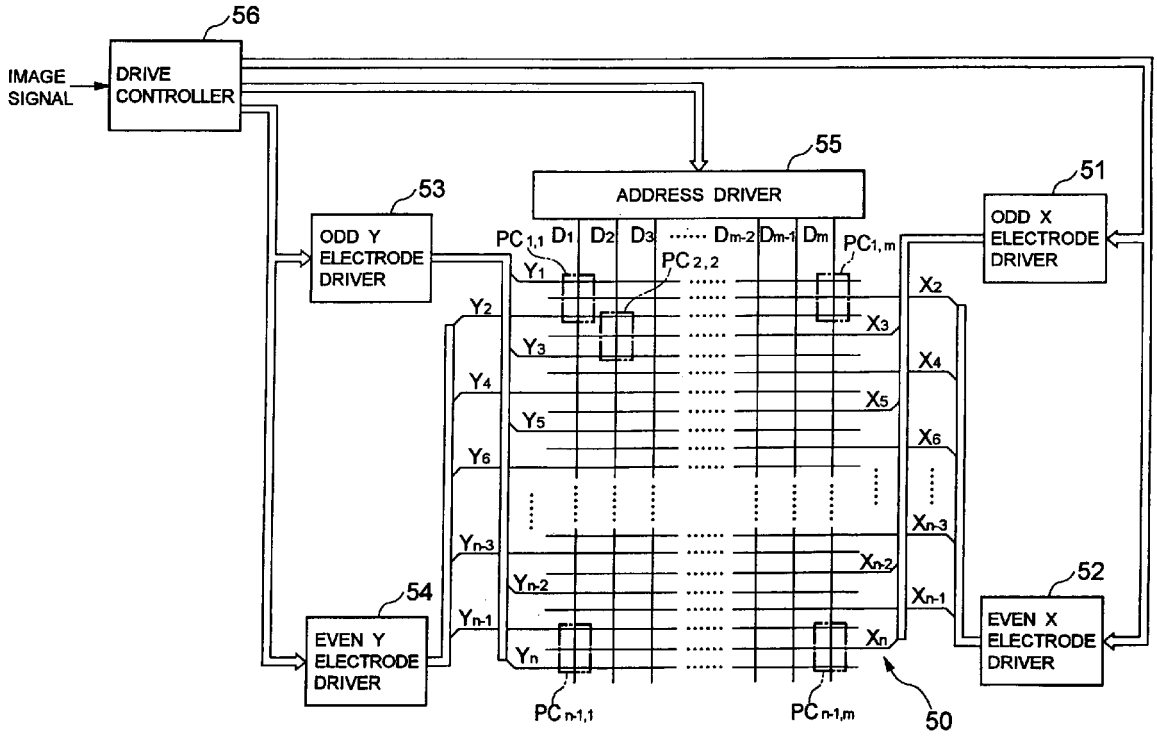
FIG. 4 is a view showing the schematic structure of a plasma display.

FIG. 4 is a view showing the structure of a plasma display as a display of one embodiment according to the invention.

As shown in FIG. 4, the plasma display comprises a PDP 50 as a plasma display panel, an odd X electrode driver 51, an even X electrode driver 52, an odd Y electrode driver 53, an even Y electrode driver 54, an address driver 55, and a drive controller 56.

Strip-shaped column electrodes $D_1$ to $D_m$ respectively extending in the vertical direction on the display screen are formed in the PDP 50. Further, strip-shaped row electrodes $X_2$ to $X_n$ and row electrodes $Y_1$ to $Y_n$ respectively extending in the horizontal direction on the display screen are alternatively arranged in the PDP 50 in the order of the increasing number. Each pair of row electrodes, namely, a pair of the row electrodes ($X_2$, $Y_2$) to a pair of the row electrodes ($X_n$, $Y_n$) corresponds to each of the first display line to the (n−1)-th display line. A pixel cell PC serving as a pixel is formed at each intersection of each display line and each column electrode $D_1$ to $D_m$ (the area surrounded by one-dotted chain line in FIG. 4). Namely, the pixel cells $PC_{1,1}$ to $PC_{1,m}$ belonging to the first display line, the pixel cells $PC_{2,1}$ to $PC_{2,m}$ belonging to the second display line, and the pixel cells $PC_{n-1,1}$ to $PC_{n-1,m}$ belonging to the (n−1)-th display line are arranged in matrix.

FIG. 5 to FIG. 8 are views respectively showing one portion taken away from the internal structure of the PDP 50.

Figure 5:
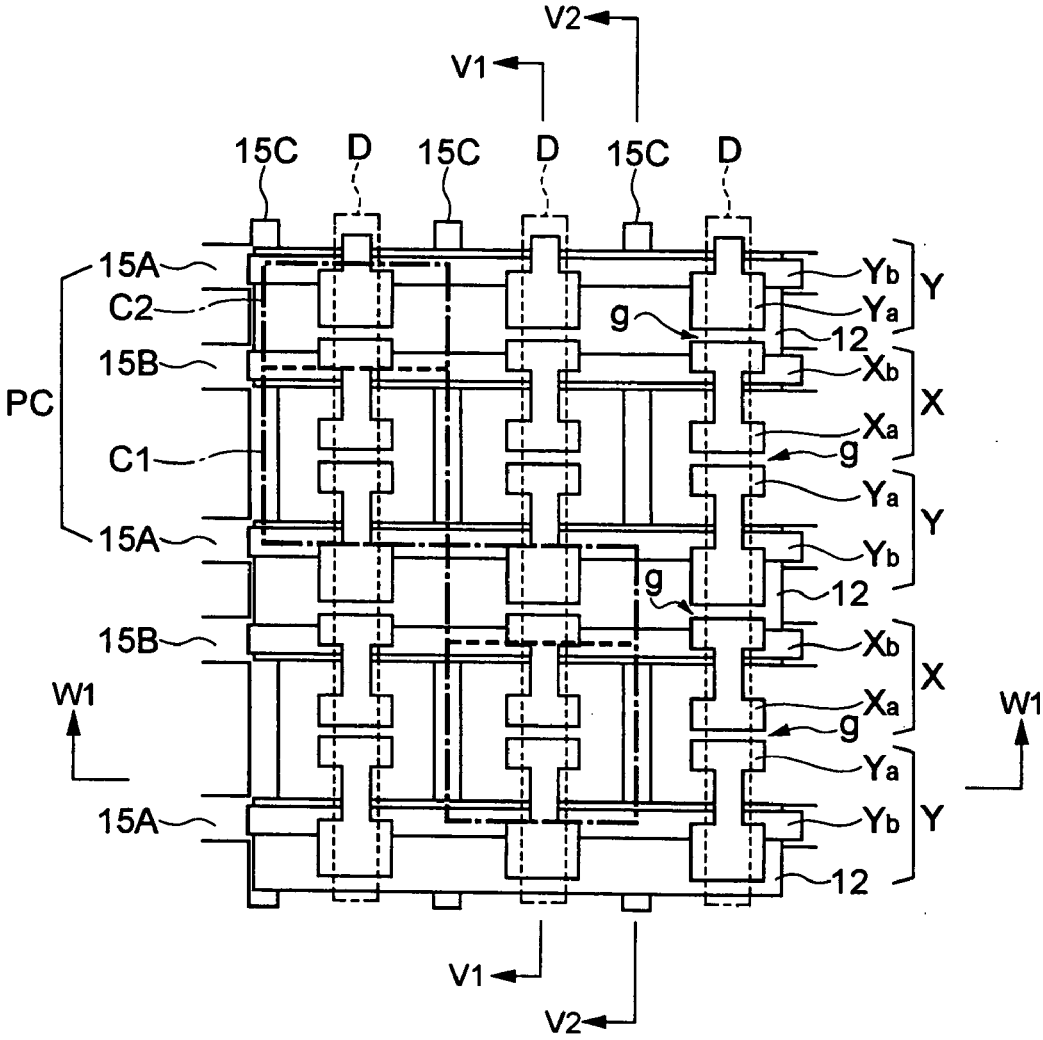
FIG. 5 is a plan view show in one of the structure of the PDP 50 viewed from the side of a display surface.
Figure 6:
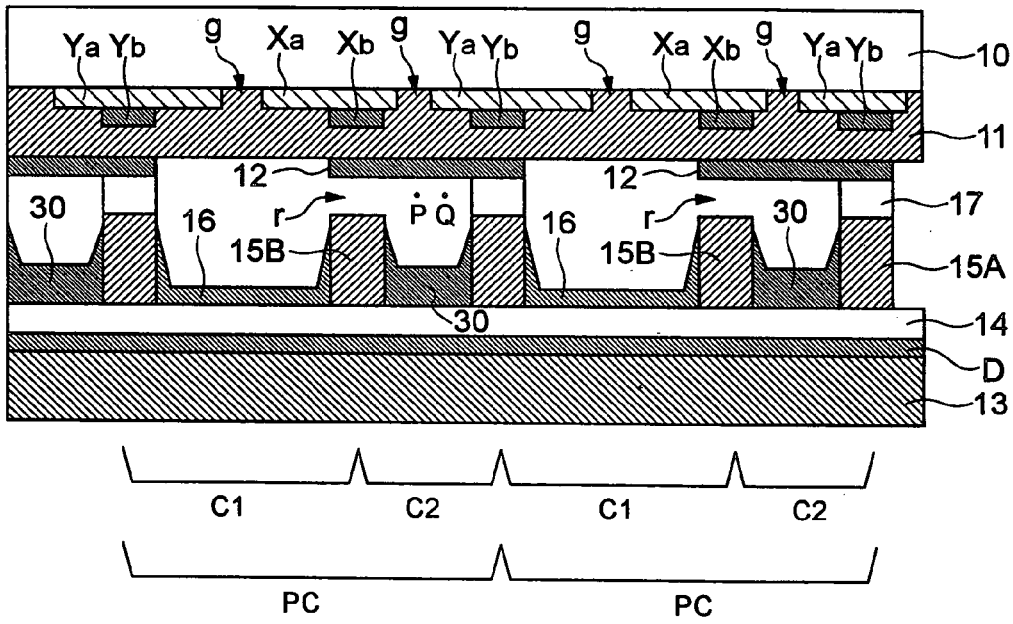
FIG. 6 is a cross sectional view of the PDP 50 taken along the line V1—V1 shown in FIG. 5.
Figure 7:
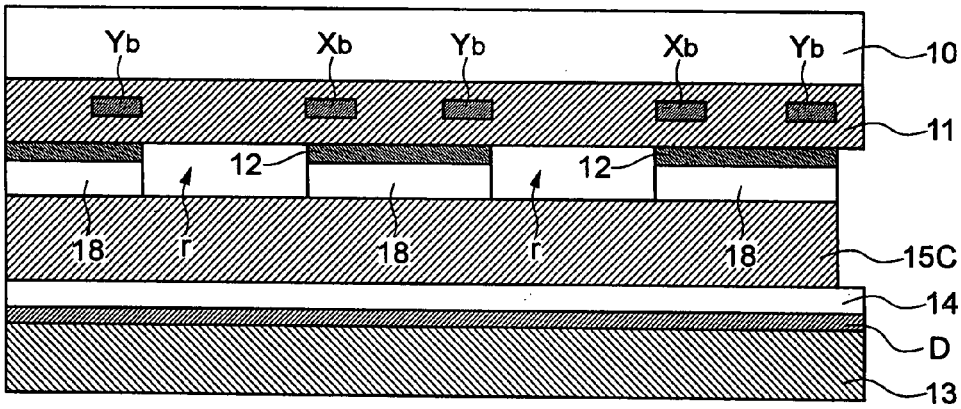
FIG. 7 is a cross sectional view of the PDP 50 taken along the line V2—V2 shown in FIG. 5.
Figure 8:
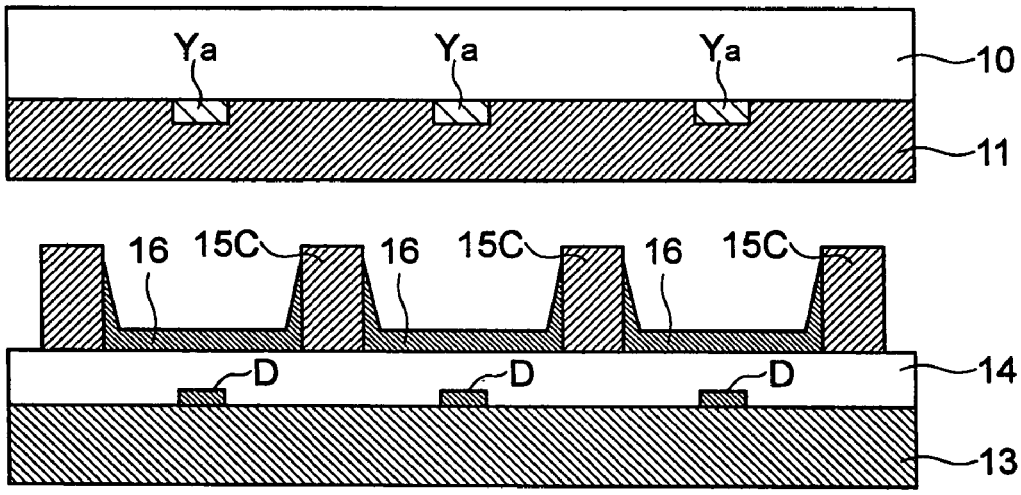
FIG. 8 is a cross sectional view of the PDP 50 taken along the line W1—W1 shown in FIG. 5.

FIG. 5 is a plan view showing the PDP 50 viewed from the side of a display surface. FIG. 6 is a cross sectional view of the PDP 50 taken along the line V1—V1 shown in FIG. 5. FIG. 7 is a cross sectional view of the PDP 50 taken along the line V2—V2 shown in FIG. 5. FIG. 8 is a cross sectional view of the PDP 50 taken along the line W1—W1 shown in FIG. 5.

As illustrated in FIG. 5, the row electrode Y is formed by a strip-shaped bus electrode Yb (the main body of the row electrode Y) extending in the horizontal direction on the display screen and a plurality of transparent electrodes Ya connected to the bus electrode Yb. The bus electrode Yb is made of, for example, a black metal film. The transparent electrode Ya is made of a transparent conductive film such as ITO, and they are arranged in the respective positions corresponding to the respective column electrodes D on the bus electrode Yb. The transparent electrode Ya extends in the direction perpendicular to the bus electrode Yb and one end and the other end thereof are expanded as shown in FIG. 5. Namely, the transparent electrode Ya can be regarded as the protrudent electrode protruding from the main body of the row electrode Y. The row electrode X is formed by a strip-shaped bus electrode Xb (main body of the row electrode X) extending in the horizontal direction on the display screen and a plurality of transparent electrodes Xa connected to the bus electrode Xb. The bus electrode Xb is made of, for example, a black metal film. The transparent electrode Xa is made of a transparent conductive film such as ITO, and they are arranged in the respective positions corresponding to the respective column electrodes D on the bus electrode Xb. The transparent electrode Xa extends in the direction perpendicular to the bus electrode Xb and one end and the other end thereof are expanded as shown in FIG. 5. Namely, the transparent electrode Xa can be regarded as the protrudent electrode protruding from the main body of the tow electrode X. The respective wide portions of the transparent electrode Xa and Ya stand face to face with a discharge gap g. Namely, the transparent electrodes Xa and Ya as the protrudent electrodes protruding from each main body of the row electrodes X and Y in pair are arranged at the opposite positions with the discharge gap g.

The row electrodes Y each consisting of the transparent electrodes Ya and the bus electrode Yb and the row electrodes X each consisting of the transparent electrodes Xa and the bus electrode Xb are formed on the rear surface of a front glass substrate 10 serving as the display surface of the PDP 50, as shown in FIG. 6. A dielectric layer 11 is formed on the rear surface of the front glass substrate 10 so as to cover these row electrodes X and Y. An augmentative dielectric layer 12 protruding from the dielectric layer 11 toward the rear surface is formed in each position corresponding to a control discharge cell C2 (described later) on the surface of the dielectric layer 11. The augmentative dielectric layer 12 is made of a strip-shaped light absorptive layer including a black or a dark colorant and extends in the horizontal direction on the display surface, as shown in FIG. 5. The surface of the augmentative dielectric layer 12 and the surface of the dielectric layer 11 where the augmentative dielectric layer 12 is not formed are covered with a protective layer made of MgO, not illustrated. On a rear substrate 13 arranged in parallel with the front glass substrate 10, the several column electrodes D extending in the direction perpendicular to the respective bus electrodes Xb and Yb (vertical direction) are arranged in parallel with each predetermined space. A white column electrode protective layer (dielectric layer) 14 for covering the column electrodes D is formed on the rear substrate 13. A partition wall 15 consisting of a first transversal wall 15A, a second transversal wall 15B, and a longitudinal wall 15C is formed on the column electrode protective layer 14. The first transversal wall 15A extends on the column electrode protective layer 14 at the opposite position to the bus electrode Yb, in the horizontal direction on the display surface. The second transversal wall 15B extends on the column electrode protective layer 14 at the opposite position to the bus electrode Xb, in the horizontal direction on the display surface. The longitudinal wall 15C extends at a position between the transparent electrodes Xa (Ya) arranged at a regular intervals on the bus electrode Xb (Yb), in a direction perpendicular to the bus electrode Xb (Yb). As illustrated in FIG. 6, a second electron emissive layer 30 is formed in the area on the column electrode protective layer 14 (including the longitudinal wall 15C and the side surfaces of the first transversal wall 15A and the second transversal wall 15B), opposite to the augmentative dielectric layer 12. The second electron emissive layer 30 is a layer made of high gamma material of low work function (for example, 4.2 eV and less), that is, excellent second electron emissive coefficient. As the material used for the second electron emissive layer 30, there are alkaline earth metal oxide such as MgO, CaO, SrO, and BaO and alkali metal oxide such as $Cs_2O$, fluoride such as $CaF_2$ and $MgF_2$, $TiQ_2$, $Y_2O$, or the material improved in the second electron emissive coefficient by crystal flaw or impurity dope. While, a phosphor layer 16 is formed on the area other than the opposite area of the augmentative dielectric layer 12, on the column electrode protective layer 14 (including the longitudinal wall 15C and the side surfaces of the first transversal wall 15A and the second transversal wall 15B), as shown in FIG. 6. The phosphor layer 16 includes three of a red fluorescent layer emitting red color, a green fluorescent layer emitting green color, and a blue fluorescent layer emitting blue color, and the assignment thereof is determined in each pixel cell PC. A discharge space sealed with the discharge gas exists between the second electron emissive layer 30, the phosphor layer 16, and the dielectric layer 11. Each height of the first transversal wall 15A, the second transversal wall 15B, and the longitudinal wall 15C is not so high as to reach the surfaces of the augmentative dielectric layer 12 and the dielectric layer 11, as shown in FIG. 6 and FIG. 8. Accordingly, as shown in FIG. 6, there exists an interstice r capable of flowing of the discharge gas, between the second transversal wall 15B and the augmentative dielectric layer 12. Between the first transversal wall 15A and the augmentative dielectric layer 12, however, there is formed the dielectric layer 17 extending in the direction along the first transversal wall 15A so as to prevent from the flow out of the discharge gas. Between the longitudinal wall 15C and the augmentative dielectric layer 12, a dielectric layer 18 is continuously formed in a direction along the longitudinal wall 15C, as shown in FIG. 7.

The area surrounded by the first transversal wall 15A and the longitudinal wall 15C (the area surrounded by one-dotted chain line in FIG. 5) becomes the pixel cell PC serving as a pixel. As illustrated in FIG. 5 and FIG. 6, the pixel cell PC is divided into a display discharge cell C1 and a control discharge cell C2 by the second transversal wall 15B. The display discharge cell C1 includes a pair of row electrodes X and Y and each transparent electrode Xa and Ya corresponding to each display line, and the phosphor layer 16. While, the control discharge cell C2 includes the augmentative dielectric layer 12, the second electron emissive layer 30, the transparent electrode Xa of the row electrode X of the row electrode pair corresponding to the display line, and the transparent electrode Ya of the row electrode pair corresponding to the display line adjacent to the upper portion of the display surface. As shown in FIG. 5, the discharge gap g between the wide portion of the transparent electrode Xa and the wide portion of the transparent electrode Xb is formed at a medium position between the bus electrodes Xb and Yb within the display discharge cell C1. While, the discharge gap g is formed at a position deviated from the medium position between the bus electrodes Xb and Yb toward the display discharge cell C1.

As shown in FIG. 6, each discharge space of the pixel cell PC neighboring in a vertical direction on the display surface (horizontal direction in FIG. 6) is blocked by the first transversal wall 15A and the dielectric layer 17. The respective discharge spaces of the display discharge cell C1 and the control discharge cell C2 belonging to the same pixel cell PC communicate with each other through the interstice r, as shown in FIG. 6. Each discharge space of the control discharge cell C2 neighboring in a horizontal direction on the display surface is blocked by the augmentative dielectric layer 12 and the dielectric layer 18, as shown in FIG. 7. However, the discharge spaces of the display discharge cells C1 neighboring in a horizontal direction on the display surface communicate with each other.

Thus, each pixel cell of the pixel cells $PC_{1,1}$ to $PC_{n-1,m}$ formed on the PDP 50 is formed by the display discharge cell C1 and the control discharge cell C2 whose discharge spaces communicating with each other.

The odd X electrode driver 51 applies various drive pulses (described later) to the row electrodes $X_3, X_5, \ldots, X_{n-2}$ and $X_n$ with the odd numbers (shown in FIG. 4) attached, within the row electrodes X of the PDP 50, according to the timing signal supplied from the drive controller 56. The even X electrode driver 52 applies various drive pulses (described later) to the row electrodes $X_2, X_4, \ldots, X_{n-3}$, and $X_{n-1}$ with the even numbers (shown in FIG. 4) attached, within the row electrodes X of the PDP 50, according to the timing signal supplied from the drive controller 56. The odd Y electrode driver 53 applies various drive pulses (described later) to the row electrodes $Y_1, Y_3, Y_5, \ldots, Y_{n-2}$, and $Y_n$ with the odd numbers (shown in FIG. 4) attached, within the row electrodes Y of the PDP 50, according to the timing signal supplied from the drive controller 56. The even Y electrode driver 54 applies various drive pulses (described later) to the row electrodes $Y_2, Y_4, \ldots, Y_{n-3}$, and $Y_{n-1}$ with the even numbers (shown in FIG. 4) attached, within the row electrodes Y of the PDP 50, according to the timing signal supplied from the drive controller 56. The address driver 55 applies the pixel data pulse (described later) to the column electrodes $D_1$ to $D_m$ of the PDP 50, according to the timing signal supplied from the drive controller 56.

The drive controller 56 converts the input image signal into the pixel data of, for example, 8 bits, for showing the brightness level in each pixel, and then the error diffusion processing and the dither processing are performed on the pixel data. For example, in the error diffusion processing, at first the display data for the upper 6 bits of the pixel data is regarded as the display data and the remaining data for the lower 2 bits is regarded as the error data. Each weighted error data of the pixel data corresponding to the peripheral pixels is reflected in the above display data. According to the operation, the brightness for the lower 2 bits in the original pixel is represented by the peripheral pixels in a simulated way, and therefore, the display data for 6 bits less than 8 bits can represent the same brightness gradation as the pixel data for the above 8 bits. The dither processing is performed on the error diffusion processed pixel data of 6 bits obtained by this error diffusion processing. In the dither processing, a plurality of pixels adjacent to each other are regarded as the unit of one pixel, the dither coefficients having the different coefficients are respectively assigned and added to the error diffusion processed pixel data corresponding to each pixel within this unit, thereby obtaining the dither added pixel data. According to this addition of the dither coefficient, from the viewpoint of the above one pixel unit, it is possible to represent the brightness corresponding to 8 bits with only the upper 4 bits of the dither added pixel data. The drive controller 56 regards the upper 4 bits of the dither added pixel data as the multiple gradation pixel data $PD_s$, and this is converted into the pixel drive data GD of 15 bits consisting of the first to the fifteenth bits according to the data conversion table as shown in FIG. 9. Accordingly, the pixel data capable of representing the 256-gradation by 8 bits is converted into the pixel drive data GD of 15 bits consisting of 16 patterns in total, as shown in FIG. 9. By separating the respective pixel drive data $GD_{1,1}$ to $GD_{(n-1),m}$ by the same bit class, in every pixel drive data $GD_{1,1}$ to $GD_{(n-1),m}$ for one screen, the drive controller 56 obtains the pixel drive data bit groups DB1 to DB15 as follows:

DB1: the first bits of the respective pixel drive data $GD_{1,1}$ to $GD_{(n-1),m}$ DB2: the second bits of the respective pixel drive data $GD_{1,1}$ to $GD_{(n-1),m}$ DB3: the third bits of the respective pixel drive data $GD_{1,1}$ to $GD_{(n-1),m}$ DB4: the fourth bits of the respective pixel drive data $GD_{1,1}$ to $GD_{(n-1),m}$ DB5: the fifth bits of the respective pixel drive data $GD_{1,1}$ to $GD_{(n-1),m}$ DB6: the sixth bits of the respective pixel drive data $GD_{1,1}$ to $GD_{(n-1),m}$ DB7: the seventh bits of the respective pixel drive $GD_{1,1}$ to $GD_{(n-1),m}$ DB8: the eighth bits of the respective pixel drive data $GD_{1,1}$ to $GD_{(n-1),m}$ DB9: the ninth bits of the respective pixel drive data $GD_{1,1}$ to $GD_{(n-1),m}$ DB10: the tenth bits of the respective pixel drive data $GD_{1,1}$ to $GD_{(n-1),m}$ DB11: the eleventh bits of the respective pixel drive data $GD_{1,1}$ to $GD_{(n-1),m}$ DB12: the twelfth bits of the respective pixel drive data $GD_{1,1}$ to $GD_{(n-1),m}$ DB13: the thirteenth bits of the respective pixel drive data $GD_{1,1}$ to $GD_{(n-1),m}$ DB14: the fourteenth bits of the respective pixel drive data $GD_{1,1}$ to $GD_{(n-1),m}$ DB15: the fifteenth bits of the respective pixel drive data $GD_{1,1}$ to $GD_{(n-1),m}$ The respective pixel drive data bit groups DB1 to DB15 correspond to the respective subfields SF1 to SF15 described later. The drive controller 56 supplies the pixel drive data bit group DB corresponding to the subfield, to the address driver 55 by every one display line (m), in every subfield SF1 to SF15.

Figure 10:
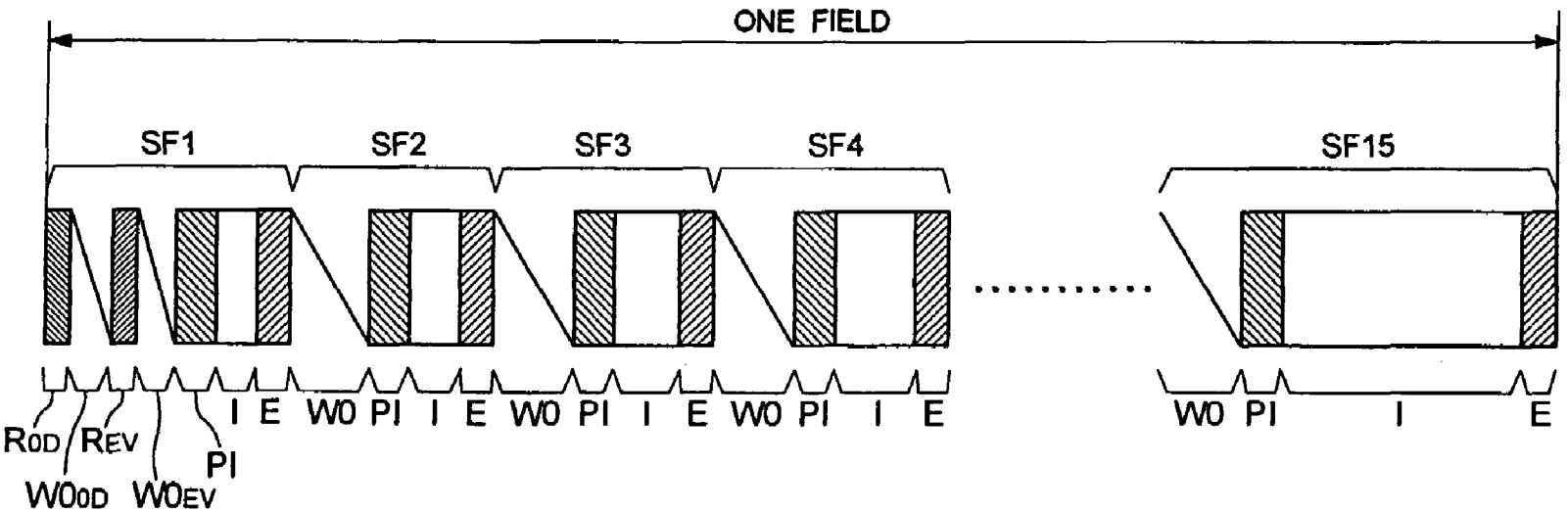
FIG. 10 is a view showing an example of the light-emission drive format in the plasma display shown in FIG. 4.

Further, the drive controller 56 generates various timing signals to control the drive of the PDP 50 according to the light-emission drive sequence as shown in FIG. 10 and supplies them to the odd X electrode driver 51, the even X electrode driver 52, the odd Y electrode driver 53, and the even Y electrode driver 54.

In the light-emission drive sequence shown in FIG. 10, each field in an image signal is divided into 15 subfields of SF1 to SF15 and various driving stages as described below are performed in each subfield.

In the head subfield SF1, an odd row reset stage $R_{OD}$, an odd row address stage $WO_{OD}$, an even row reset stage $R_{EV}$, an even row address stage $W_{EV}$, a priming expansion stage PI, a sustain stage I, and an erase stage E are sequentially performed. In the respective subfields SF2 to SF15, the address stage WO, the priming expansion stage PI, the sustain stage I, and the erase stage E are sequentially performed.

Figure 11:
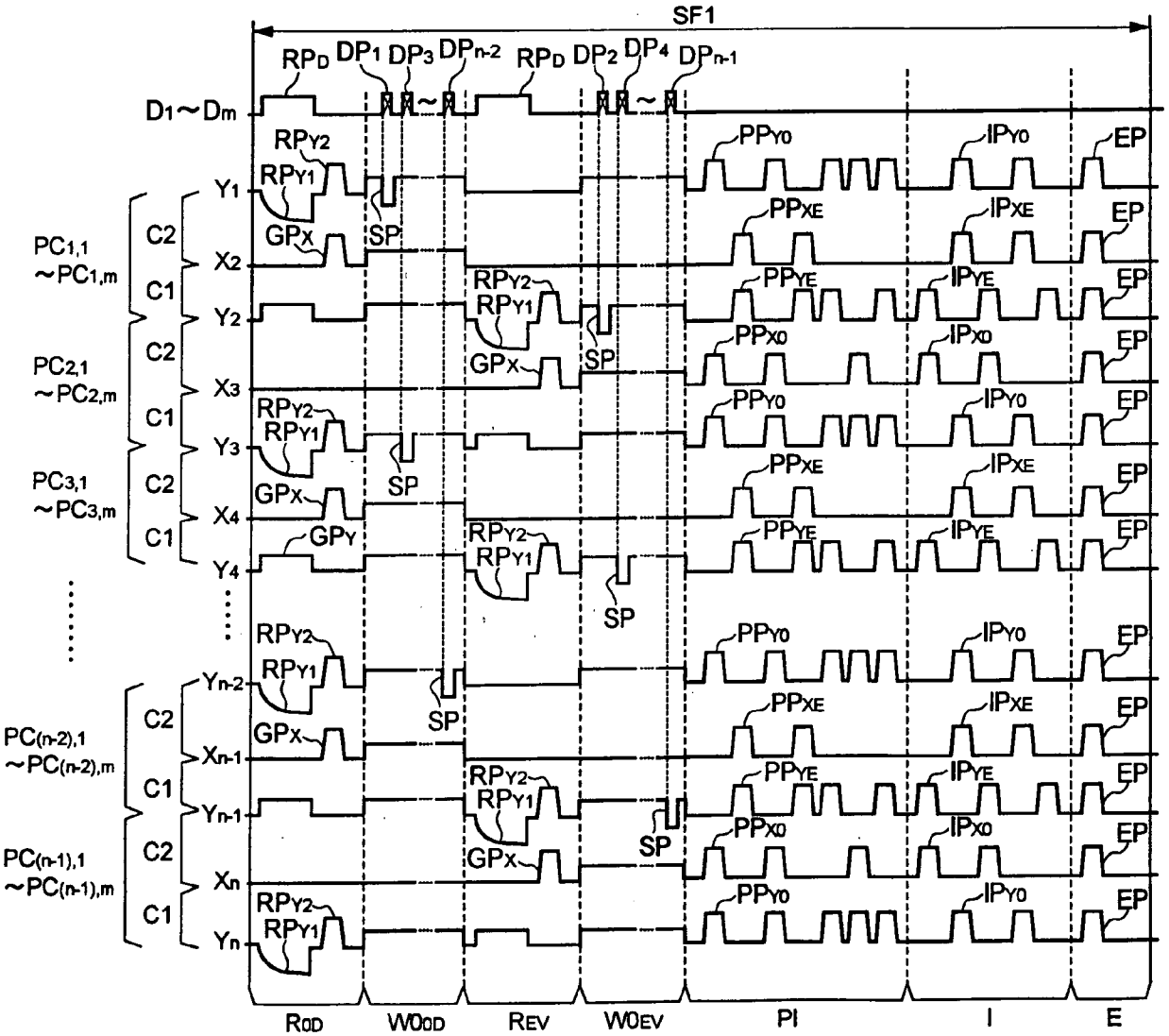
FIG. 11 is a view showing various drive pulses to be applied to the PDP 50 and the applying timing thereof, in the head subfield SF1, according to the light-emission drive format shown in FIG. 10.

FIG. 11 is a view showing various drive pulses to be applied to the PDP 50 by the odd X electrode driver 51, the even X electrode driver 52, the odd Y electrode driver 53, the even Y electrode driver 54, and the address driver 55 and the applying timing thereof.

At first, in the odd row reset stage $R_{OD}$ of the subfield SF1, the odd Y electrode driver 53 generates a first reset pulse $RP_{Y1}$ of negative polarity falling and rising more gradually than the sustain pulse (described later) and simultaneously applies the above reset pulse to the respective odd row electrodes $Y_1, Y_3, Y_5, \ldots, Y_n$ of the PDP 50. At this time, the address driver 55 generates a reset pulse $RP_D$ of positive polarity and simultaneously applies the above reset pulse to the respective column electrodes $D_1$ to $D_n$. In reply to the application of the first reset pulse $RP_{Y1}$ and the reset pulse $RP_D$, first reset discharges (writing discharges) are produced within the control discharge cells C2 of the respective pixel cells $PC_{1,1}$ to $PC_{1,m}$, $PC_{3,1}$ to $PC_{3,m}, \ldots, PC_{n-2,1}$ to $PC_{n-2,m}$ belonging to the odd display lines. Namely, the first reset discharge is produced between the row electrode Y and the column electrode D within the control discharge cell C2, as shown in FIG. 5 and FIG. 6, and according to the first reset discharge, the wall charges are produced within the control discharge cells C2 of the respective pixel cells PCs belonging to the odd display lines as mentioned above. In the odd row reset stage $R_{OD}$, after application of the first reset pulse $RP_{Y1}$, the odd Y electrode driver 53 simultaneously applies a second reset pulse $RP_{Y2}$ of positive polarity to the respective odd row electrodes $Y_1, Y_3, \ldots, Y_n$, as shown in FIG. 11. In reply to the application of the second reset pulse $RP_{Y2}$, the second reset discharges (erase discharges) are produced within the control discharge cells C2 of the respective pixel cells PCs belonging to the odd display lines. Namely, the second reset discharge is produced between the row electrode Y and the column electrode D within the control discharge cell C2 as shown in FIG. 5 and FIG. 6 and according to this second reset discharge, the wall discharges formed within the control discharge cells C2 of the respective pixel cells PCs belonging to the odd display lines are extinguished. At this time, the even X electrode driver 52 applies an error discharge prevention pulse $GP_X$ of positive polarity as shown in FIG. 11 to the respective even row electrodes $X_2, X_4, X_6, \ldots, X_{n-1}$, at the same applying timing as the second reset pulse $RP_{Y2}$, so as not to produce a discharge by mistake between the row electrode X and the column electrode D within the control discharge cell C2.

As mentioned above, in the odd row reset stage $R_{OD}$, all the wall charges are extinguished from the control discharge cells C2 of the respective pixel cells $PC_{1,1}$ to $PC_{1,m}$, $PC_{3,1}$ to $PC_{3,m}, \ldots, PC_{n-2,1}$ to $PC_{n-2,m}$ belonging to the odd display lines of the PDP 50 and all the pixel cells PCs belonging to the odd display lines are initialized into the light-off state.

In the odd row address stage $WO_{OD}$ of the subfield SF1, the odd Y electrode driver 53 sequentially applies the scanning pulse SP of negative polarity to the odd row electrodes $Y_1, Y_3, Y_5, \ldots, Y_{n-2}$. At this time, the address driver 55 converts the corresponding data to the odd display lines, within the pixel drive data bit group DB1 corresponding to the subfield SF1, into the pixel data pulse DP having a pulse voltage depending on its logical level. For example, the address driver 55 converts the pixel drive data bit of the logical level 1 into the pixel data pulse DP of high voltage of positive polarity, while converting the pixel drive data bit of the logical level 0 into the pixel data pulse DP of low voltage (0 v). It applies the same pixel data pulse DP to the column electrodes $D_1$ to $D_m$ by every one display line (m) in synchronization with the applying timing of the scanning pulse SP. Namely, the address driver 55 converts the pixel drive data bits $DB1_{1,1}$ to $DB1_{1,m}$, $DB1_{3,1}$ to $DB1_{3,m}$, . . . , $DB1_{n-2,1}$ to $DB1_{n-2,m}$ into the pixel data pulses $DP_{1,1}$ to $DP_{1,m}$ $DP_{3,1}$ to $DP_{3,m}$, . . . , $DP_{n-2,1}$ to $DP_{n-2,m}$ and applies these to the column electrodes $D_1$ to $D_m$ by every one display line.

At this time, the writing address discharge is produced between the column electrode D and the row electrode Y within the control discharge cell C2 of the pixel cell PC where the scanning pulse SP and the pixel data pulse DP of high voltage are applied, and the wall charge within the control discharge cell C2 is formed. While, the above-mentioned writing address discharge is not produced within the control discharge cell C2 of the pixel cell PC where the scanning pulse SP is applied but the pixel data pulse DP of high voltage is not applied, and therefore, the wall charge is not formed within the control discharge cell C2. At this time, the even X electrode driver 52 applies the voltage of the same polarity as the pixel data pulse DP to these even row electrodes X, so as not to produce each discharge by mistake between the bus electrodes Xb of the respective row electrodes $X_2$, $X_4$, $X_6$, . . . , $X_{n-1}$ with the odd numbers attached and the column electrodes D.

As mentioned above, in the odd row address stage $WO_{OD}$, the writing address discharge is selectively produced within the control discharge cell C2 of each pixel cell PC belonging to the odd display lines of the PDP 50, depending on the pixel drive data bit group DB 1 (the first bits of the pixel drive data GD shown in FIG. 9), so to form the wall charge. Thus, the respective pixel cells PCs belonging to the odd display lines are set at the temporarily light-on state (the wall charge exists within the control discharge cell C2) or the light-off state (no wall charge exists within the control discharge cell C2).

In the even row reset stage $R_{EV}$ of the subfield SF1, the even Y electrode driver 54 generates the first reset pulse $RP_{Y1}$ of negative polarity falling and rising more gradually than the sustain pulse (described later) and simultaneously applies the above reset pulse to the respective even row electrodes $Y_2$, $Y_4$, . . . , $Y_{n-1}$ of the PDP 50. At this time, the address driver 55 generates the reset pulse $RP_D$ of positive polarity and simultaneously applies the above reset pulse to the respective column electrodes $D_1$ to $D_n$. In reply to the application of the first reset pulse $RP_{Y1}$ and the reset pulse $RP_D$, the first reset discharges (writing discharges) are produced within the control discharge cells C2 of the respective pixel cells $PC_{2,1}$ to $PC_{2,m}$, $PC_{4,1}$ to $PC_{4,m}$, . . . , $PC_{n-1,1}$ to $PC_{n-1,m}$ belonging to the even display lines. Namely, the first reset discharge is produced between the row electrode Y and the column electrode D within the control discharge cell C2, as shown in FIG. 5 and FIG. 6, and according to the first reset discharge, the wall charges are produced within the control discharge cells C2 of the respective pixel cells PCs belonging to the even display lines as mentioned above. In the even row reset stage $R_{EV}$, after application of the first reset pulse $RP_{Y1}$, the even Y electrode driver 54 simultaneously applies the second reset pulse $RP_{Y2}$ of positive polarity as shown in FIG. 11 to the respective even row electrodes $Y_2$, $Y_4$, . . . , $Y_{n-1}$. In reply to the application of the second reset pulse $RP_{Y2}$, the second reset discharges (erase discharges) are produced within the control discharge cells C2 of the respective pixel cells PCs belonging to the even display lines. Namely, the second reset discharge is produced between the row electrode Y and the column electrode D within the control discharge cell C2 as shown in FIG. 5 and FIG. 6 and according to this second reset discharge, the wall discharges formed within the control discharge cells C2 of the respective pixel cells PCs belonging to the even display lines are extinguished. At this time, the odd X electrode driver 51 applies the error discharge prevention pulse $GP_X$ of positive polarity as shown in FIG. 11 to the respective odd row electrodes $X_3$, $X_5$, . . . , $X_n$, at the same applying timing as the second reset pulse $RP_{Y2}$, so as not to produce a discharge by mistake between the row electrode X and the column electrode D within the control discharge cell C2.

As mentioned above, in the even row reset stage $R_{EV}$, all the wall charges are extinguished from the control discharge cells C2 of the respective pixel cells $PC_{2,1}$ to $PC_{2,m}$, $PC_{4,1}$ to $PC_{4,m}$, . . . , $PC_{n-1,1}$ to $PC_{n-1,m}$ belonging to the even display lines of the PDP 50 and all the pixel cells PCs belonging to the even display lines are initialized into the light-off state.

In the even row address stage $WO_{EV}$ of the subfield SF1, the even Y electrode driver 54 sequentially applies the scanning pulse SP of negative polarity to the even row electrodes $Y_2$, $Y_4$, . . . , $Y_{n-1}$. In this case, the address driver 55 converts the corresponding data to the even display lines, within the pixel drive data bit group DB1 corresponding to the subfield SF1, into the pixel data pulse DP having a pulse voltage depending on its logical level. For example, the address driver 55 converts the pixel drive data bit of the logical level 1 into the pixel data pulse DP of high voltage of positive polarity, while converting the pixel drive data bit of the logical level 0 into the pixel data pulse DP of low voltage (0 v). It applies the same pixel data pulse DP to the column electrodes $D_1$ to $D_m$ by every one display line (m) in synchronization with the applying timing of the scanning pulse SP. Namely, the address driver 55 converts the pixel drive data bits $DB1_{2,1}$ to $DB1_{2,m}$, $DB1_{4,1}$ to $DB1_{4,m}$, . . . , $DB1_{n-1,1}$ to $DB1_{n-1,m}$ into the pixel data pulses $DP_{2,1}$ to $DP_{2,m}$, $DP_{4,1}$ to $DP_{4,m}$, . . . , $DP_{n-1,1}$ to $DP_{n-1,m}$ and applies these to the column electrodes $D_1$ to $D_m$ by every one display line. At this time, the writing address discharge is produced between the column electrode D and the row electrode Y within the control discharge cell C2 of the pixel cell PC where the scanning pulse SP and the pixel data pulse DP of high voltage are applied, and the wall charge is formed within the control discharge cell C2. While, the above-mentioned writing address discharge is not produced within the control discharge cell C2 of the pixel cell PC where the scanning pulse SP is applied but the pixel data pulse DP of high voltage is not applied, and therefore, the wall charge is not formed within the control discharge cell C2. In this case, the odd X electrode driver 51 applies the voltage of the same polarity as the pixel data pulse DP, to these odd row electrodes X, so as not to produce each discharge by mistake between the respective bus electrodes Xb of the respective row electrodes $X_3$, $X_5$, . . . , $X_n$ with the odd numbers attached and the respective column electrodes D.

As mentioned above, in the even row address stage $WO_{EV}$, the wall charges are produced within the control discharge cells C2 of the respective pixel cells PCs belonging to the even display lines of the PDP 50, selectively depending on the pixel drive data bit group DB1 (the first bits of the pixel drive data GD shown in FIG. 9). Thus, the respective pixel cells PCs belonging to the even display lines are set at the temporarily light-on state (the wall charge exists within the control discharge cell C2) or the light-off state (no wall charge exists within the control discharge cell C2).

Figure 12:
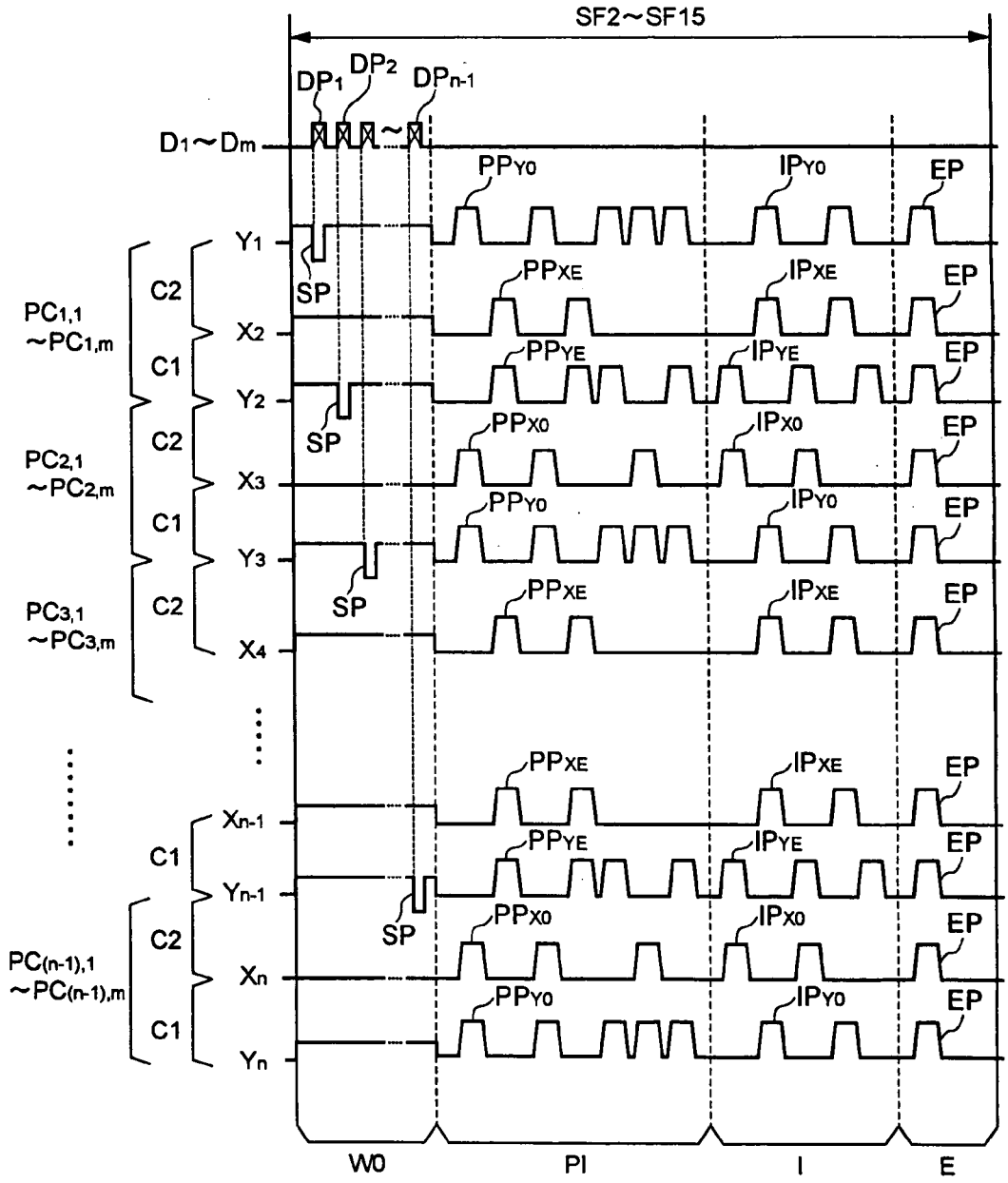
FIG. 12 is a view showing various drive pulses to be applied to the PDP 50 and the applying timing thereof, in the subfields SF2 to SF15, according to the light-emission drive format shown in FIG. 10.

In the address stage WO of each of the subfields SF2 to SF15, the odd Y electrode driver 53 and the even X electrode driver 54 sequentially apply the scanning pulse SP of negative polarity to the respective row electrodes $Y_1$, $Y_2$, $Y_3$, . . . , $Y_{n-1}$, as shown in FIG. 12. In this case, the address driver 55 converts the respective pixel drive data bits in the pixel drive data bit group DB(j) corresponding to the subfield SF(j) (j is the natural number of 2 to 15), into the pixel data pulse DP having a pulse voltage corresponding to the logical level. For example, the address driver 55 converts the pixel drive data bit of the logical level 1 into the pixel data pulse DP of high voltage of positive polarity, while converting the pixel drive data bit of the logical level 0 into the pixel data pulse DP of low voltage (0 v). It applies the above pixel data pulse DP to the column electrodes $D_1$ to $D_m$ by every one display line (m) in synchronization with the applying timing of the scanning pulse SP. Namely, the address driver 55 converts the pixel drive data bits $DB(j)_{1,1}$ to $DB(j)_{1,m}$, $DB(j)_{2,1}$ to $DB(j)_{2,m}$, . . . , $DB(j)_{n-1,1}$ to $DB(j)_{n-1,m}$ into the pixel data pulses $DP_{1,1}$ to $DP_{1,m}$, $DP_{2,1}$ to $DP_{2,m}$, . . . , $DP_{n-1,1}$ to $DP_{n-1,m}$ and applies these to the column electrodes $D_1$ to $D_m$ by every one display line. At this time, the writing address discharge is produced between the column electrode D and the row electrode Y within the control discharge cell C2 of the pixel cell PC where the scanning pulse SP and the pixel data pulse DP of high voltage are applied, and the wall charge is formed within the control discharge cell C2. While, the above-mentioned writing address discharge is not produced within the control discharge cell C2 of the pixel cell PC where the scanning pulse SP is applied but the pixel data pulse DP of high voltage is not applied, and therefore, the wall charge is not formed within the control discharge cell C2.

As mentioned above, in the address stage WO, the wall charge is formed within the control discharge cell C2 of the pixel cell PC, selectively depending on the logical level of the j-th bit of the pixel drive data GD corresponding to the subfield SF(j) to which the address stage WO belongs. Thus, the respective pixel cells PCs of the PDP 50 are set at a provisional light-on state (the wall charge exists within the control discharge cell C2) or the light-off state (no wall charge exists within the control discharge cell C2).

In the priming expansion stage PI of each of the subfields SF1 to SF15, the odd Y electrode driver 53 continuously and repeatedly applies the priming pulse $PP_{YO}$ of positive polarity to the odd row electrodes $Y_1$, $Y_3$, . . . , $Y_n$, as shown in FIG. 11 or FIG. 12. In the priming expansion stage PI, the odd X electrode driver 51 continuously and repeatedly applies the priming pulse $PP_{XO}$ of positive polarity to the odd row electrodes $X_3$, $X_5$, . . . , $X_n$, as shown in FIG. 11 or FIG. 12. In the priming expansion stage PI, the even X electrode driver 52 continuously and repeatedly applies the priming pulse $PP_{XE}$ of positive polarity to the even row electrodes $X_2$, $X_4$, . . . , $X_{n-1}$, as shown in FIG. 11 and FIG. 12. In the priming expansion stage PI, the even Y electrode driver 54 continuously and repeatedly applies the priming pulse $PP_{YE}$ of positive polarity to the even row electrodes $Y_2$, $Y_4$, . . . , $Y_{n-1}$, as shown in FIG. 11 and FIG. 12. Every time the priming pulse $PP_{XO}$, $PP_{XE}$, $PP_{YO}$, or $PP_{YE}$ is applied, the priming discharge is produced between the row electrodes X and Y within the control discharge cell C2 of the pixel cell PC set at the temporarily light-on state. In this case, every time the priming discharge is produced, a discharge is expanded toward the display discharge cell C1 through the interstice r shown in FIG. 6, and the wall charge is formed within the display discharge cell C1.

As mentioned above, by producing the priming discharge repeatedly in the control discharge cell C2 set at the temporarily light-on state, in the odd row address stage $WO_{OD}$, the even row address stage $WO_{EV}$, or the address stage WO, the discharge is gradually expanded toward the display discharge cell C1, in the priming expansion stage PI. Owing to the discharge expansion, the wall charge is formed within the display discharge cell C1, and the pixel cell PC to which this display discharge cell C1 belong is set at the light-on state. While, in the above-mentioned various address stages, the priming discharge never occurs in the control discharge cell C2 set at the light-off state. Accordingly, since the wall charge is not formed within the display discharge cell C1 communicating with the control discharge cell C2, the pixel cell PC is set at the light-off state.

In the sustain stage I of each of the subfields SF1 to SF15, the odd Y electrode driver 53 applies the sustain pulse $IP_{YO}$ of positive polarity to the respective odd row electrodes $Y_1$, $Y_3$, $Y_5'$, . . . , $Y_n$, repeatedly for the number of the times assigned to the subfield to which the sustain stage I belongs, as shown in FIG. 11 and FIG. 12. At the same timing as the sustain pulse $IP_{YO}$, the even X electrode driver 52 applies the sustain pulse $IP_{XE}$ of positive polarity respectively to the even row electrodes $X_2$, $X_4$, . . . , $X_{n-1}$, repeatedly for the number of the times assigned to the subfield to which the sustain stage I belongs. In the sustain stage I, the odd X electrode driver 51 applies the sustain pulse $IP_{XO}$ of positive polarity respectively to the odd row electrodes $X_3$, $X_5$, . . . , $X_n$, repeatedly for the number of the times assigned to the subfield to which the sustain stage I belongs, as shown in FIG. 11 and FIG. 12. Further, in the sustain stage I, the even Y electrode driver 54 applies the sustain pulse $IP_{YE}$ of positive polarity respectively to the even row electrodes $Y_2$, $Y_4$, . . . , $Y_{n-1}$, repeatedly for the number of the times assigned to the subfield to which the sustain stage I belongs. As shown in FIG. 11 and FIG. 12, the applying timing of the sustain pulses $IP_{XE}$ and $IP_{YO}$ is deviated from that of the sustain pulses $IP_{XO}$ and $IP_{YE}$. Every time the sustain pulse $IP_{XO}$, $IP_{XE}$, $IP_{YO}$ or $IP_{YE}$ is applied, the sustain discharge is produced between the transparent electrodes Xa and Ya within the display discharge cell C1 of the pixel cell PC set at the light-on state. At this time, owing to the ultraviolet ray produced by this sustain discharge, the phosphor layer 16 (red fluorescent layer, green fluorescent layer, blue fluorescent layer) formed in the display discharge cell C1 as shown in FIG. 6 is excited and the light corresponding to the fluorescent color is radiated through the front glass substrate 10. Namely, light emission accompanying the sustain discharge is repeatedly produced for the number of the times assigned to the subfield to which the sustain stage I belongs.

As mentioned above, in the sustain stage I, only the pixel cell PC set at the light-on state is repeatedly made to emit light for the number of the times assigned to each subfield.

In the erase stage E of each of the subfields SF1 to SF15, the odd X electrode driver 51, the even X electrode driver 52, the odd Y electrode driver 53, the even Y electrode driver 54, and the address driver 55 apply the erase pulse of positive polarity to all the row electrodes X and Y, as shown in FIG. 11 and FIG. 12. According to the application of the erase pulse, the erase discharges are produced within all the control discharge cells C2 where the wall charges are left, so to erase the wall charges.

Thus, in the erase stage E, by producing the erase discharge only in the control discharge cell C2 where the wall charge is left, the state of the charge generation within all the control discharge cells C2 is initialized into a uniform state.

Here, when the driving operations as shown in FIG. 10 to FIG. 12 are performed, based on the pixel drive data GD of 16 types shown in FIG. 9, the writing address discharges (indicated by the double circle in FIG. 9) are produced in the address stages ($WO_{OD}$, $WO_{EV}$, WO) of the respective subfields continuous during the period corresponding to the medium brightness to be represented, in each field. Namely, the pixel cells PCs are set at the light-on state in the respective subfields continuous for the period corresponding to the medium brightness to be represented, and they sustain the discharge in the sustain stages I of these subfields. At this time, the brightness corresponding to the total sum of the sustain discharges excited within one field is visible. Namely, according to the 16 types of the light emission patterns corresponding to the first to the sixteenth gradation drivings shown in FIG. 9, the medium brightness for the 16 gradation can be represented correspondingly to the total number of the times of discharges produced in the subfields indicated by the double circle.

Here, in the plasma display shown in FIG. 4, each pixel cell PC serving as each pixel of the PDP 50 is formed by a display discharge cell C1 and a control discharge cell C2, as shown in FIG. 5 and FIG. 6. While producing the sustain discharge not related to the display image in the display discharge cell C1, the plasma display produces the reset discharge, the priming discharge, and the address discharge accompanied by the light emission not related to the display image, in the control discharge cell C2. At this time, the control discharge cell C2 has the augmentative dielectric layer 12 formed, consisting of a light absorptive layer including a black or a dark colorant, so as to prevent the light by the various discharges produced within the control discharge cell C2 from passing through the front glass substrate 10 and leaking outward. Accordingly, since the discharge light accompanying the reset discharge, the priming discharge, and the address discharge is blocked by the augmentative dielectric layer 12, it is possible to enhance the contrast, especially the dark contrast of the display image. Further, the second electron emissive layer 30 is provided within the control discharge cell C2 on the rear substrate 13's side, as shown in FIG. 6. According to the second electron emissive layer 30, the discharge starting voltage and the discharge sustain voltage between the column electrode D and the row electrode Y within the control discharge cell C2 get lower than the discharge starting voltage and the discharge sustain voltage between the column electrode D and the row electrode Y within the display discharge cell C1. Namely, the display discharge cell C1 has the higher discharge starting voltage and discharge sustain voltage than the control discharge cell C2. Accordingly, by producing the priming discharge repeatedly within the control discharge cell C2, the discharge produced within the display discharge cell C1 is weak even if performing the priming expansion stage PI for expanding the discharge to the side of the display discharge cell C1, thereby restraining the decrease of the dark contrast.

As shown in FIG. 5, in the control discharge cell C2, the discharge gap g is provided between the transparent electrodes Xa and Ya protrudent from the respective main bodies of the row electrodes X and Y, at a position deviated from the position intermediate between the bus electrodes Xb and Yb toward the display discharge cell C1 paired with this control discharge cell C2. Therefore, according to the driving operations shown in FIG. 11 and FIG. 12, the priming discharge is produced at a position corresponding to the discharge gap g within the control discharge cell C2, for example, at the position P shown in FIG. 6. Namely, within the control discharge cell C2, since the priming discharge is produced at a position near the display discharge cell C1 paired with the control discharge cell C2, the discharge can be easily expanded from the control discharge cell C2 to the display discharge cell C1. While, the reset discharge and the writing address discharge are produced between the column electrode D and the transparent electrode Ya within the control discharge cell C2. Namely, the reset discharge and the writing address discharge produced within the control discharge cell C2 are produced between the transparent electrode Ya having the longer distance to the display discharge cell C1 paired with the control discharge cell C2 than to the transparent electrode Xa and the column electrode D. These reset discharge and the address discharge are produced at a position Q farther away from the display discharge cell C1 paired with the control discharge cell C2 than the position P where the priming discharge is produced as shown in FIG. 6. The flow amount of the ultraviolet ray accompanying the reset discharge and the address discharge, into the display discharge cell C1 is reduced, thereby restraining the decrease of the dark contrast.

By forming the discharge gap g within the control discharge cell C2 at a position near the display discharge cell C1, as shown in FIG. 5 and FIG. 6, the area of the wide protrudent portion of the transparent electrode Ya facing the control discharge cell C2 can be made larger than the area of the wide protrudent portion of the transparent electrode Xa facing the control discharge cell C2. Thus, the stability of the reset discharge and the address discharge produced between the column electrode D and the wide protrudent portion of the transparent electrode Ya within the control discharge cell C2 is increased, thereby making easy the transition of the discharge of the display discharge cell C1 in the priming discharge.

In the above embodiment, although the case of adopting the method of selectively forming the wall charge within each pixel cell PC in the address stage, what is called, the selective-write address method, has been described, the selective-erase address method for selectively erasing the wall charge formed on each pixel cell PC may be adopted.

In the driving operation based on the selective-erase address method, the drive controller 56 converts the input image signal into the pixel data of, for example, 8 bits, for showing the brightness level in each pixel, and then the error diffusion processing and the dither processing are performed on the pixel data. The drive controller 56 converts the pixel data of 8 bits into the multiple gradation pixel data $PD_s$ of 4 bits by the error diffusion processing and the dither processing, and further converts the multiple gradation pixel data $PD_s$ into the pixel drive data GD of 15 bits according to the data conversion table shown in FIG. 13. The mark "*" described in the conversion table shown in FIG. 13 indicates that the logical level may take either value of 1 or 0. Accordingly, the pixel data capable of representing the 256-gradation by 8 bits is converted into the pixel drive data GD of 15 bits consisting of 16 patterns in total. By separating the respective pixel drive data $GD_{1,1}$ to $GD_{(n-1),m}$ into drive data groups of the same bit digit, for each unit of pixel drive data $GD_{1,1}$ to $GD_{(n-1),m}$ for one screen, the drive controller 56 obtains the pixel drive data bit groups DB1 to DB15. The drive controller 56 supplies the pixel drive data bit group DB corresponding to the subfield to the address driver 55 by every one display line (m), in every subfield SF1 to SF15.

Figure 14:
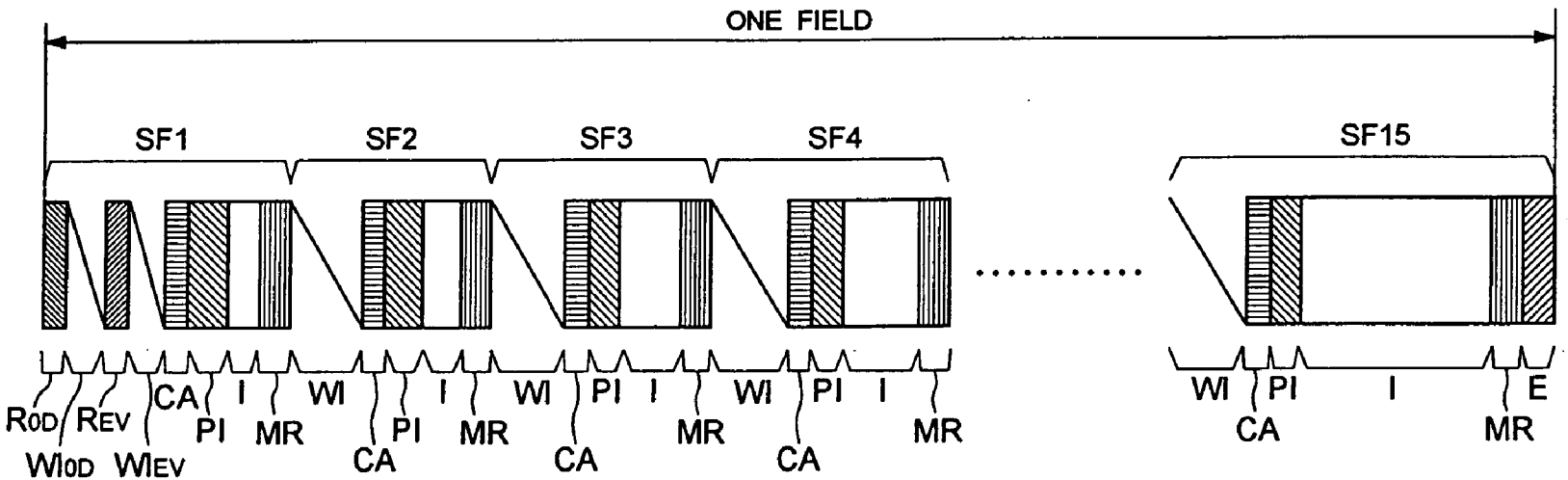
FIG. 14 is a view showing another example of the light-emission drive format in the plasma display shown in FIG. 4.

FIG. 14 is a view showing the light-emission drive format in the gradation driving of the PDP 50 by using the selective-erase address method.

In the light-emission drive sequence shown in FIG. 14, each field in the image signal is divided into 15 subfields of SF1 to SF15, and the respective driving operations will be performed in each subfield, as described below.

In the head subfield SF1, the odd row reset stage $R_{OD}$, the odd row address stage $WI_{OD}$, the even row reset stage $R_{EV}$, the even row address stage $WI_{EV}$, a selective-erase auxiliary stage CA, the priming expansion stage PI, the sustain stage I, and an charge transition stage MR are sequentially performed. In the respective subfields SF2 to SF15, the address stage W1, the selective-erase auxiliary stage CA, the priming expansion stage PI, the sustain stage I, and the charge transition stage MR are sequentially performed. In the last subfield SF15, the erase stage (not illustrated) is performed just after the charge transition stage MR.

Figure 15:
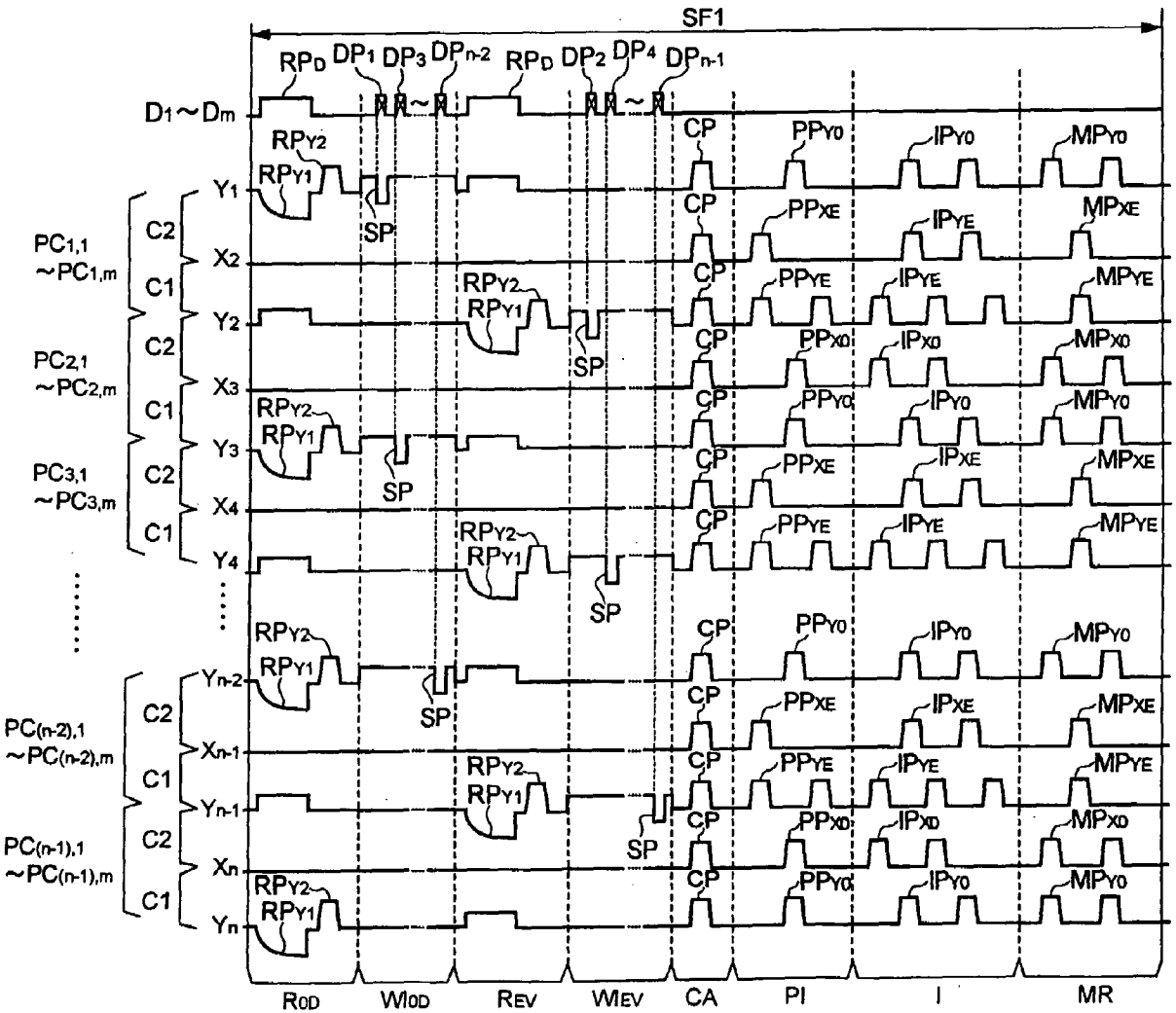
FIG. 15 is a view showing various drive pulses to be applied to the PSP 50 and the applying timing thereof, in the head subfield SF1, according to the light-emission drive format shown in FIG. 14.
Figure 16:
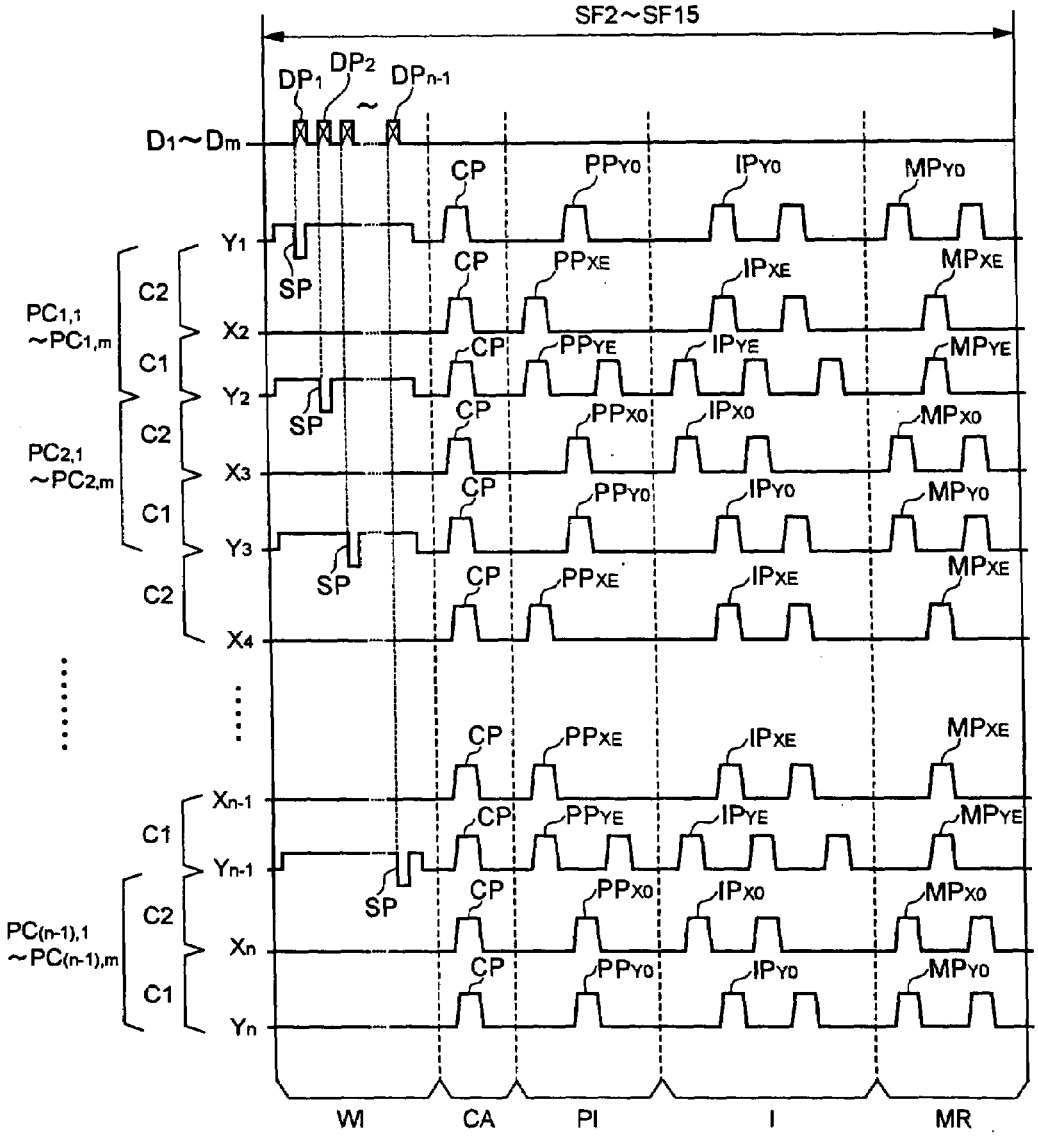
FIG. 16 is a view showing various drive pulses to be applied to the PDP 50 and the applying timing thereof, in the subfields SF2 to SF15, according to the light-emission drive format shown in FIG. 14.

FIG. 15 and FIG. 16 are views each showing various drive pulses to be applied to the PDP 50 in order to operate the PDP 50 according to the light-emission drive format shown in FIG. 14 and the applying timing thereof.

At first, in the odd row reset stage $R_{OD}$ of the subfield SF1, the odd Y electrode driver 53 generates the first reset pulse $RP_{Y1}$ of negative polarity falling and rising more gradually than the sustain pulse (described later) and simultaneously applies the above reset pulse to the respective odd row electrodes $Y_1, Y_3, Y_5, \ldots, Y_n$ of the PDP 50. At this time, the address driver 55 generates the reset pulse $RP_D$ of positive polarity and simultaneously applies the above reset pulse to the respective column electrodes $D_1$ to $D_n$. In reply to the application of the first reset pulse $RP_{Y1}$ and the reset pulse $RP_D$, the first reset discharges (writing discharge) are produced in the control discharge cells C2 of the respective pixel cells $PC_{1,1}$ to $PC_{1,m}$, $PC_{3,1}$ to $PC_{3,m}$, . . . , $PC_{n-2,1}$ to $PC_{n-2,m}$ belonging to the odd display lines. Namely, the first reset discharge is produced between the row electrode Y and the column electrode D within the control discharge cell C2, as shown in FIG. 5 and FIG. 6. While applying the first reset pulse $RP_{Y1}$ and the reset pulse $RP_D$, the even Y electrode driver 54 applies the potential of positive polarity to the even row electrodes $Y_2, Y_4, Y_6, \ldots, Y_{n-1}$, so as not to produce the discharges by mistake within the control discharge cells C2 of the pixel cells PCs belonging to the even display lines. After application of the first reset pulse $RP_{Y1}$, the odd Y electrode driver 53 simultaneously applies the second reset pulse $RP_{Y2}$ of positive polarity as shown in FIG. 15 to the respective odd row electrodes $Y_1, Y_3, \ldots, Y_n$. In reply to the application of the second reset pulse $RP_{Y2}$, the second reset discharges (writing discharges) are produced within the control discharge cells C2 of the respective pixel cells PCs belonging to the odd display lines. Namely, the second reset discharge is produced between the row electrode Y and the column electrode D within the control discharge cell C2 as shown in FIG. 5 and FIG. 6. According to the first reset discharge and the second reset discharge as mentioned above, the wall charges are produced within the control discharge cells C2 of the respective pixel cells PCs belonging to the odd display lines.

As mentioned above, in the odd row reset stage $R_{OD}$, the first and the second reset discharges are produced within the control discharge cells C2 of all the pixel cells PCs belonging to the odd display lines of the PDP 50, hence to form the wall discharges within the control discharge cells C2 belonging to the odd display lines.

In the odd row address stage $WI_{OD}$ of the subfield SF1, the odd Y electrode driver 53 sequentially applies the scanning pulse SP of negative polarity to the odd row electrodes $Y_1, Y_3, Y_5, \ldots, Y_{n-2}$ of the PDP 50. At this time, the address driver 55 converts the corresponding data to the odd display lines, within the pixel drive data bit group DB1 corresponding to the subfield SF1, into the pixel data pulse DP having a pulse voltage depending on its logical level. For example, the address driver 55 converts the pixel drive data bit of the logical level 1 into the pixel data pulse DP of high voltage of positive polarity, while converting the pixel drive data bit of the logical level 0 into the pixel data pulse DP of low voltage (0 v). It applies the same pixel data pulse DP to the column electrodes $D_1$ to $D_m$ by every one display line (m) in synchronization with the applying timing of the scanning pulse SP. Namely, the address driver 55 converts the pixel drive data bits $DB1_1$ to $DB1_{1,m}$, $DB1_{3,1}$ to $DB1_{3,m}$, . . . , $DB1_{n-2,1}$ to $DB1_{n-2,m}$ into the pixel data pulses $DP_{1,1}$ to $DP1_{1,m}$, $DP_{3,1}$ to $DP_{3,m}$, . . . , $DP_{n-2,1}$ to $DP_{n-2,m}$ and applies these to the column electrodes $D_1$ to $D_m$ by every one display line.

At this time, the erasing address discharge is produced between the column electrode D and the row electrode Y within the control discharge cell C2 of the pixel cell PC where the scanning pulse SP and the pixel data pulse DP of high voltage are applied, and the wall charge formed within the control discharge cell C2 is extinguished. While, the above-mentioned erasing address discharge is not produced within the control discharge cell C2 of the pixel cell PC where the scanning pulse SP is applied but the pixel data pulse DP of high voltage is not applied, and therefore, the wall charge is left within the control discharge cell C2.

As mentioned above, in the odd row address stage $WI_{OD}$, the erasing address discharge is selectively produced within the control discharge cell C2 of each pixel cell PC belonging to the odd display lines of the PDP 50, depending on the pixel drive data bit group DB1 (the first bits of the pixel drive data GD shown in FIG. 13), so to extinguish the wall charge. Thus, the respective pixel cells PCs belonging to the odd display lines are set at the temporarily light-on state (the wall charge exists within the control discharge cell C2) or the light-off state (no wall charge exists within the control discharge cell C2).

In the even row reset stage $R_{EV}$ of the subfield SF1, the even Y electrode driver 54 generates the first reset pulse $RP_{Y1}$ of negative polarity falling and rising more gradually than the sustain pulse (described later) and simultaneously applies the above reset pulse to the respective even row electrodes $Y_2, Y_4, \ldots, Y_{n-1}$ of the PDP 50. At this time, the address driver 55 generates the reset pulse $R_{PD}$ of positive polarity and simultaneously applies the above reset pulse to the respective column electrodes $D_1$ to $D_n$. In reply to the application of the first reset pulse $RP_{Y1}$ and the reset pulse $RP_D$, the first reset discharges (writing discharges) are produced in the control discharge cells C2 of the respective pixel cells $PC_{2,1}$ to $PC_{2,m}$, $PC_{4,1}$ to $PC_{4,m}$, . . . , $PC_{n-1,1}$ to $PC_{n-1,m}$ belonging to the even display lines. Namely, the first reset discharge is produced between the row electrode Y and the column electrode D within the control discharge cell C2, as shown in FIG. 5 and FIG. 6. While the first reset pulse $RP_{Y1}$ and the reset pulse $RP_D$ are applied, the odd Y electrode driver 53 applies the potential of positive polarity to the respective odd row electrodes $Y_1, Y_3, Y_5, \ldots, Y_n$, so as not to produce the discharges by mistake within the control discharge cells C2 of the respective pixel cells PCs belonging to the odd display lines. After application of the first reset pulse $RP_{Y1}$, the even Y electrode driver 54 simultaneously applies the second reset pulse $RP_{Y2}$ of positive polarity as shown in FIG. 15 to the respective even row electrodes $Y_2, Y_4, \ldots, Y_{n-1}$. In reply to the application of the second reset pulse $RP_{Y2}$, the second reset discharges (writing discharges) are produced within the control discharge cells C2 of the respective pixel cells PCs belonging to the even display lines. Namely, the second reset discharge is produced between the row electrode Y and the column electrode D within the control discharge cell C2 as shown in FIG. 5 and FIG. 6. According to the above-mentioned first reset discharge and second reset discharge, the wall discharges are produced within the control discharge cells C2 of the respective pixel cells PCs belonging to the even display lines.

As mentioned above, in the even row reset stage $R_{EV}$, the first and second reset discharges are produced within the control discharge cells C2 of all the respective pixel cells PCs belonging to the even display lines of the PDP 50, hence to form the wall charges within the control discharge cells C2 belonging to the even display lines.

In the even row address stage $WI_{EV}$ of the subfield SF1, the even Y electrode driver 54 sequentially applies the scanning pulse SP of negative polarity to the even row electrodes $Y_2, Y_4, \ldots, Y_{n-1}$. At this time, the address driver 55 converts the corresponding data to the even display lines, within the pixel drive data bit group DB1 corresponding to the subfield SF1, into the pixel data pulse DP having a pulse voltage depending on its logical level. For example, the address driver 55 converts the pixel drive data bit of the logical level 1 into the pixel data pulse DP of high voltage of positive polarity, while converting the pixel drive data bit of the logical level 0 into the pixel data pulse DP of low voltage (0 v). It applies the same pixel data pulse DP to the column electrodes $D_1$ to $D_m$ by every one display line (m) in synchronization with the applying timing of the scanning pulse SP. Namely, the address driver 55 converts the pixel drive data bits $DB1_{2,1}$ to $DB1_{2,m}$, $DB1_{4,1}$ to $DB1_{4,m}, \ldots$, $DB1_{n-1,1}$ to $DB1_{n-1,m}$ corresponding to the even display lines into the pixel data pulses $DP_{2,1}$ to $DP_{2,m}$, $DP_{4,1}$ to $DP_{4,m}, \ldots, DP_{n-1,1}$ to $DP_{n-1,m}$ and applies these to the column electrodes $D_1$ to $D_m$ by every one display line. At this time, the erasing address discharge is produced between the column electrode D and the row electrode Y within the control discharge cell C2 of the pixel cell PC where the scanning pulse SP and the pixel data pulse DP of high voltage are applied, and the wall charge within the control discharge cell C2 is extinguished. While, the above-mentioned erasing address discharge is not produced within the control discharge cell C2 of the pixel cell PC where the scanning pulse SP is applied but the pixel data pulse DP of high voltage is not applied, and therefore, the wall charge is left within the control discharge cell C2.

As mentioned above, in the even row address stage $WI_{EV}$, the erasing address discharge is selectively produced within the control discharge cell C2 of each pixel cell PC belonging to the even display lines of the PDP 50, depending on the pixel drive data bit group DB1 (the first bits of the pixel drive data GD shown in FIG. 13). Thus, the respective pixel cells PCs belonging to the even display lines are set at the temporarily light-on state (the wall charge exists within the control discharge cell C2) or the light-off state (no wall charge exists within the control discharge cell C2).

In the address stage W1 of each of the subfields SF2 to SF15, the odd Y electrode driver 53 and the even X electrode driver 54 sequentially apply the scanning pulse SP of negative polarity to the respective row electrodes $Y_1, Y_2, Y_3, \ldots, Y_{n-1}$, as shown in FIG. 16. In this case, the address driver 55 converts the respective pixel drive data bits in the pixel drive data bit group DB(j) corresponding to the subfield SF(j) (j is the natural number of 2 to 15), into the pixel data pulse DP having a pulse voltage corresponding to the logical level. For example, the address driver 55 converts the pixel drive data bit of the logical level 1 into the pixel data pulse DP of high voltage of positive polarity, while converting the pixel drive data bit of the logical level 0 nto the pixel data pulse DP of low voltage (0 v). It applies the above pixel data pulse DP to the column electrodes $D_1$ to $D_m$ by every one display line (m) in synchronization with the applying timing of the scanning pulse SP. Namely, the address driver 55 converts the pixel drive data bits $DB(j)_{1,1}$ to $DB(j)_{1,m}$, $DB(j)_{2,1}$ to $DB(j)_{2,m}, \ldots, DB(j)_{n-1,1}$ to $DB(j)_{n-1,m}$ into the pixel data pulses $DP_{1,1}$ to $DP_{1,m}$, $DP_{2,1}$ to $DP_{2,m}, \ldots$, $DP_{n-1,1}$ to $DP_{n-1,m}$ and applies these to the column electrodes $D_1$ to $D_m$ by every one display line. At this time, the erasing address discharge is produced between the column electrode D and the row electrode Y within the control discharge cell C2 of the pixel cell PC where the scanning pulse SP and the pixel data pulse DP of high voltage are applied, and the wall charge within the control discharge cell C2 is extinguished. While, the above-mentioned erasing address discharge is not produced within the control discharge cell C2 of the pixel cell PC where the scanning pulse SP is applied but the pixel data pulse DP of high voltage is not applied. Therefore, the control discharge cell C2 where the wall charge is formed maintains the state with the wall charge formed, while the control discharge cell C2 where the wall charge does not exist maintains the state without the wall charge.

As mentioned above, in the address stage W1 of each of the subfields SF2 to SF15, the wall charges existing within the control discharge cells C2 of the respective pixel cells PCs are selectively extinguished, depending on the logical level of the j-th bit of the pixel drive data GD corresponding to the subfield SF(j) to which the the address stage W1 belongs. Thus, the respective pixel cells PCs of the PDP 50 are set at the temporarily light-on state (the wall charge exists within the control discharge cell C2) or the light-off state (no wall charge exists within the control discharge cell C2).

Figure 17A:
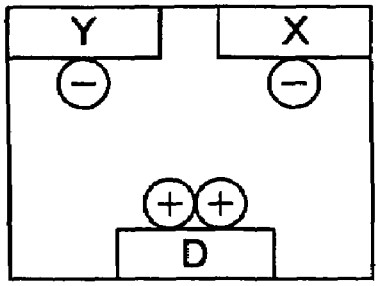
FIG. 17A and FIG. 17B are views schematically showing the charge forming state respectively in the case where the erasing address discharge has been produced correctly and in the case where the discharge has not been produced correctly.
Figure 17B:
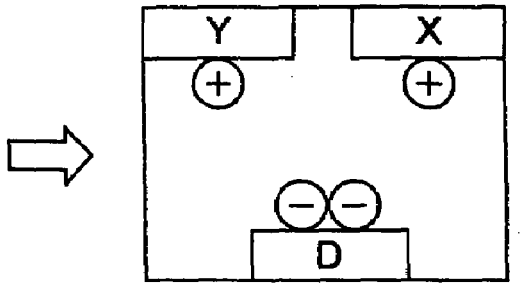

In the selective-erase auxiliary stage CA of each of the subfields SF1 to SF15, the odd X electrode driver 51, the even X electrode driver 52, the odd Y electrode driver 53, and the even Y electrode driver 54 apply a cancel pulse CP of positive polarity to all the row electrodes $X_2$ to $X_n$ and $Y_1$ to $Y_n$, as shown in FIG. 15 and FIG. 16. Owing to the application of the cancel pulse CP, the erase discharge can be produced only in the control discharge cell C2 where the erasing address discharge could not be properly produced in the address stages ($W_{OD}$, $WI_{EV}$, $W_I$), hence to extinguish the wall charge without failure. Namely, when the erasing address discharge is properly produced, the charge of negative polarity is formed within the control discharge cell C2, in the vicinity of the row electrodes X and Y, as shown in FIG. 17A. In this case, since no discharge occurs, for example, even if the voltage of positive polarity is applied to one of the row electrodes X and Y, this cell is in the light-off state. However, when the erasing address discharge is not produced properly, there is the case of forming the charge of positive polarity in the vicinity of the row electrodes X and Y, as shown in FIG. 17B. In this case, when the voltage of positive polarity is applied to one of the row electrodes X and Y, this cell discharges the electrical charge. Namely, it would be set at the temporarily light-on state by mistake in spite of having intended to set it at the light-off state.

In the selective-erase auxiliary stage CA, by applying the cancel pulse CP of positive polarity to both the row electrodes X and Y, the erase discharge is produced only in the control discharge cell C2 that is in the incorrect state of electrical charge, as shown in FIG. 17B, and turned into the correct state, as shown in FIG. 17A, namely, in the light-off state.

In the priming expansion stage PI of each of the subfields SF2 to SF15, the even X electrode driver 52 applies the priming pulse $PP_{XE}$ of positive polarity to the even row electrodes $X_2, X_4, \ldots, X_{n-1}$, as shown in FIG. 15 and FIG. 16. In the priming expansion stage PI, the even Y electrode driver 54 continuously and repeatedly-applies the priming pulse $PP_{YE}$ of positive polarity to the even row electrodes $Y_2, Y_4, \ldots, Y_{n-2}$, and $Y_n$. The odd Y electrode driver 53 applies the priming pulse $PP_{YO}$ of positive polarity to the odd row electrodes $Y_1, Y_3, \ldots, Y_n$. In the priming expansion stage PI, the odd X electrode driver 51 applies the priming pulse $PP_{XO}$ of positive polarity to the odd row electrodes $X_3, X_5, \ldots, X_n$, at the same timing as the priming pulse $PP_{YO}$. As illustrated in FIG. 15 and FIG. 16, the applying timing of the priming pulses $PP_{XO}$ and $PP_{YO}$ to be applied to the odd row electrodes X and Y is deviated from the applying timing of the priming pulses $PP_{XE}$ and $PP_{YE}$ to be applied to the even row electrodes X and Y. Every time the priming pulse $PP_{XO}$, $PP_{XE}$, $PP_{YO}$, or $PP_{YE}$ is applied, the priming discharge is produced between the row electrodes X and Y within the control discharge cell C2 of the pixel cell PC set at the temporarily light-on state. In this case, every time the priming discharge is produced, a discharge is expanded toward the display discharge cell C1 through the interstice r as shown in FIG. 6, and the wall charge is formed within the display discharge cell C1.

As mentioned above, by producing the priming discharge repeatedly in the control discharge cell C2 set at the temporarily light-on state, in the address stages ($WI_{OD}$, $WI_{EV}$, WI), the discharge is gradually expanded toward the display discharge cell C1, through the interstice r, in the priming expansion stage PI. Owing to the discharge expansion, the wall charge is formed within the display discharge cell C1, and the pixel cell PC including this display discharge cell C1 is set at the light-on state. While, since the wall charge is not formed within the display discharge cell C1 communicating with the control discharge cell C2 where the priming discharge has not been produced, the pixel cell PC maintains the light-off state.

In the sustain stage I of each of the subfields SF2 to SF15, the odd Y electrode driver 53 applies the sustain pulse $IP_{YO}$ of positive polarity to the respective odd row electrodes $Y_1, Y_3, Y_5, \ldots, Y_n$, repeatedly for the number of the times assigned to the subfield belonging to the sustain stage I, as shown in FIG. 15 and FIG. 16. At the same timing as the sustain pulse $IP_{YO}$, the even X electrode driver 52 applies the sustain pulse $IP_{XE}$ of positive polarity respectively to the even row electrodes $X_2, X_4, \ldots, X_{n-1}$, repeatedly for the number of the times assigned to the subfield belonging to the sustain stage I. In the sustain stage I, the odd X electrode driver 51 applies the sustain pulse $IP_{XO}$ of positive polarity respectively to the odd row electrodes $X_1, X_3, X_5, \ldots, X_n$, repeatedly for the number of the times assigned to the subfield belonging to the sustain stage I, as shown in FIG. 15 and FIG. 16. Further, in the sustain stage I, the even Y electrode driver 54 applies the sustain pulse $IP_{YE}$ of positive polarity respectively to the even row electrodes $Y_2, Y_4, \ldots, Y_{n-1}$, repeatedly for the number of the times assigned to the subfield to which the sustain stage I belongs. As shown in FIG. 15 and FIG. 16, the applying timing of the sustain pulses $IP_{XE}$ and $IP_{YO}$ is deviated from that of the sustain pulses $IP_{XO}$ and $IP_{YE}$. Every time the sustain pulse $IP_{XO}$, $IP_{XE}$, $IP_{YO}$ or $IP_{YE}$ is applied, the sustain discharge is produced between the transparent electrodes Xa and Ya within the display discharge cell C1 of the pixel cell PC set at the light-on state. At this time, owing to the ultraviolet ray produced by this sustain discharge, the phosphor layer 16 (red fluorescent layer, green fluorescent layer, blue fluorescent layer) formed in the display discharge cell C1 as shown in FIG. 6 is excited and the light corresponding to the fluorescent color is radiated through the front glass substrate 10. Namely, light emission accompanying the sustain discharge is repeatedly produced for the number of the times assigned to the subfield concerned with the sustain stage I.

As mentioned above, in the sustain stage I, only the pixel cell PC set at the light-on state in the proximate address stages ($WI_{OD}$, $WI_{Ev}$, WI) is repeatedly made to emit light for the number of the times assigned to the subfield.

In the charge transition stage MR of each of the subfields SF1 to SF15, the odd Y electrode driver 53 continuously and repeatedly applies the charge transition pulse $MP_{YO}$ of positive polarity to the odd row electrodes $Y_1, Y_3, \ldots, Y_n$. In the charge transition stage MR, the odd X electrode driver 51 continuously and repeatedly applies the charge transition pulse $MP_{XO}$ of positive polarity to the odd row electrodes $X_3, X_5, \ldots, X_n$ at the same timing as the charge transition pulse $MP_{YO}$. In the charge transition stage MR, the even X electrode driver 52 applies the charge transition pulse $MP_{XE}$ of positive polarity to the even row electrodes $X_2, X_4, \ldots, X_{n-1}$ and the even Y electrode driver 54 applies the charge transition pulse $MP_{YE}$ of positive polarity to the even row electrodes $Y_2, Y_4, \ldots, Y_{n-1}$ at the same timing as the above charge transition pulse $MP_{XE}$. Every time the charge transition pulse $MP_{XO}$, $MP_{YO}$, $MP_{XE}$, or $PM_{YE}$ is applied, the discharge is produced within the control discharge cell C2 of the pixel cell PC where the sustain discharge has been produced in the proximate sustain stage I. According to the discharge, the wall charge produced in the display discharge cell C1 paired with the control discharge cell C2 is moved to the control discharge cell C2 through the interstice r, as shown in FIG. 6.

Thus, in the charge transition stage MR, by discharging the control discharge cell C2 of the pixel PC where the sustain discharge has been produced in the proximate sustain stage I, the wall charge having been formed within the display discharge cell C1 is moved to the control discharge cell C2.

In the erase stage E of the last subfield SF15, the odd X electrode driver 51, the even X electrode driver 52, the odd Y electrode driver 53, the even Y electrode driver 54, and the address driver 55 apply the erase pulse of positive polarity to all the row electrodes X and Y (not illustrated). In reply to the application of the erase pulse, the erase discharges are produced within all the control discharge cells C2 where the wall charges are left, hence to erase the wall charges.

According to the driving operations using the selective-erase address method as shown in FIG. 13 to FIG. 16, opportunity capable of turning the pixel cell PC from the light-off state to the light-on state exists only in the odd row reset stage $R_{OD}$ and the even row reset stage $R_{EV}$ of the subfield SF1, in the subfields SF1 to SF15. Namely, when the erasing address discharge is produced in one subfield of the subfields SF1 to SF15 and once the pixel cell PC is set at the light-off state, this pixel cell PC never returns to the light-on state in the subfields thereafter. According to the driving operation based on the pixel drive data GD of 16 types as shown in FIG. 13, the respective pixel cells PCs are set at the light-on state in the respective subfields continuous for the period corresponding to the brightness to be represented. Before the erasing address discharge (indicated by the black circle) is produced, the sustain discharge light emission (indicated by the white circle) is continuously performed in the sustain stage I of each of the subfields.

According to the above-mentioned driving operation, the brightness corresponding to the total sum of the discharges produced in the period of one field is visible. Namely, according to the 16 types of light-emission drive patterns corresponding to the first to the sixteenth gradation drivings as shown in FIG. 13, it is possible to represent the medium brightness for 16 gradations corresponding to the total number of the times of the sustain discharges produced in the subfields indicated by the white circle.

In this case, even in the driving operation by using the selective-erase address method as mentioned above, the sustain discharge related to the display image is produced in the display discharge cell C1, while the reset discharge, the priming discharge, and the address discharge accompanied by the light emission not related to the display image are produced in the control discharge cell C2. Accordingly, since the discharge light accompanying the reset discharge, the priming discharge, and the address discharge is blocked by the augmentative dielectric layer 12 formed only in the control discharge cell C2, it is possible to enhance the contrast, especially, the dark contrast of the display image.

Even in the driving operation using the selective erasing address method, the priming discharge is produced between the transparent electrodes Xa and Ya within the control discharge cell C2, and the reset discharge and the address discharge are produced between the column electrode D and the transparent electrode Ya. Since the priming discharge is produced at a position near the display discharge cell C1 paired with the control discharge cell C2, the discharge can be easily expanded from the control discharge cell C2 to the display discharge cell C1. While, since the reset discharge and the address discharge are produced at a position farther away from the display discharge cell C1 paired with the control discharge cell C2 than the place where the priming discharge is produced, the flow amount of the ultraviolet ray accompanying the reset discharge and the address discharge, into the display discharge cell C1 is reduced, thereby suppressing the decrease in the dark contrast.

This application is based on Japanese Patent Application No. 2002-292850 which is herein incorporated by reference.

What is claimed is:

1. A display for displaying an image according to pixel data of every pixel based on an input image signal, comprising a display panel having a front substrate and a rear substrate arranged at opposite positions for interposing a discharge space therebetween, a plurality of pairs of row electrodes provided on an inner surface of the front substrate, a plurality of column electrodes arranged on an inner surface of the rear substrate in a way of intersecting with the pairs of row electrodes, and light-emission areas formed at each intersection of the row electrode pairs and the column electrodes, each of the light-emission areas consisting of a first discharge cell including a portion where the respective row electrodes in pair are opposed to each other with a first discharge gap in the discharge space and a second discharge cell including a portion where a light absorptive layer is provided on the front substrate's side and one row electrode of the row electrode pair and the other row electrode of the row electrode pair adjacent to the above row electrode pair are opposed to each other with a second discharge gap, and an address component for producing an address discharge within the second discharge cell selectively by applying a pixel data pulse based on the pixel data, to the respective column electrodes, while applying a scanning pulse to a row electrode having the longer distance to the first discharge cell, of the respective row electrodes within the second discharge cell, thereby setting the second discharge cell at a light-on state or a light-off state.

2. The display according to claim 1, further comprising a priming expansion component for expanding a discharge toward the first discharge cell to set the first discharge cell at a light-on state, by applying a priming pulse alternately to the respective row electrodes within the second discharge cell to cause a priming discharge only in the second discharge cell that is in the light-on state, and a sustain component for repeatedly applying a sustain pulse alternately to the respective row electrodes within the first discharge cell to cause a sustain discharge only in the first discharge cell that is in the light-on state.

3. The display, according to claim 1, wherein the second discharge gap is formed at a position deviated from a medium position between the respective row electrodes within the second discharge cell toward the first discharge cell.

4. The display, according to claim 1, wherein each of the row electrodes in pairs has a main body extending in a horizontal direction of the display panel and a protrudent portion protruding from the main body in a direction perpendicular to the horizontal direction in each unit light emission area, the first discharge cell includes a portion where the protrudent portions of the respective row electrodes in pair are opposed to each other with the first gap within the discharge space, and the second discharge cell includes a portion where the protrudent portion of one row electrode of the row electrode pair is opposed to the protrudent portion of the other row electrode of the row electrode pair adjacent to the above row electrode pair with the second gap within the discharge space.

5. The display, according to claim 1, wherein the discharge spaces of the respective second discharge cells adjacent in the horizontal direction of the display panel are blocked by each other and the discharge spaces of the respective first discharge cells adjacent in the horizontal direction of the display panel communicate with each other.

6. The display, according to claim 1, wherein in the light-emission area, the first discharge cell is divided from the second discharge cell by a partition wall formed on an inner surface of the rear substrate and the discharge space of the first discharge cell communicates with the discharge space of the second discharge cell through an interstice between the partition wall and the front substrate.

7. The display, according to claim 1, wherein a phosphor layer of emitting light by a discharge is formed only within the first discharge cell.

8. The display, according to claim 1, wherein a second electron emissive layer is formed on the rear substrate within the second discharge cell.

9. The display, according to claim 1, further comprising a reset component for producing reset discharges within the second discharge cells of all the light-emission areas, prior to the address discharge, by applying a reset pulse between the row electrode having the longer distance to the first discharge cell, of the respective row electrodes within the second discharge cell, and the column electrode, so as to make the column electrode at a lower potential.

10. The display, according to claim 9, wherein the reset component performs the reset discharge to be produced within the respective second discharge cells belonging to odd display lines in the display panel and the reset discharge to be produced within the respective second discharge cells belonging to even display lines in the display panel, with time difference.

11. The display, according to claim 1, wherein the address component performs the address discharge to be produced within the respective second discharge cells belonging to the odd display lines in the display panel and the address discharge to be produced within the respective second discharge cells belonging to the even display lines in the display panel, with time difference.

12. The display, according to claim 2, wherein the reset pulse has a waveform of lower transition level than the sustain pulse, in rising and falling periods.

13. The display, according to claim 9, wherein the reset pulse has a waveform of lower transition level than the sustain pulse, in rising and falling periods.

14. The display, according to claim 2, comprising an erase component for producing an erase discharge within the first discharge cell by applying an erase pulse to the respective row electrode pairs after completion of the sustain discharge.

15. The display, according to claim 2, comprising a charge transition component for moving a wall discharge from the first discharge cell to the second discharge cell, by applying a charge transition pulse between one row electrode, of the respective row electrodes within the second discharge cell, and the other row electrode of the row electrode pair adjacent to the above row electrode, after completion of the sustain discharge, and discharging only the second discharge cell paired with the first discharge cell where the sustain discharge has been produced.

16. A driving method for driving a display panel according to pixel data of every pixel based on an input image signal, the display panel having: a front substrate and a rear substrate arranged at opposite positions for interposing a discharge space therebetween; a plurality of pairs of row electrodes provided on an inner surface of the front substrate; a plurality of column electrodes arranged on an inner surface of the rear substrate in a way of intersecting with the pairs of row electrodes; and light-emission areas formed at each intersection of the row electrode pairs and the column electrodes, each of the light-emission areas consisting of a first discharge cell including a portion where the respective row electrodes in pair are opposed to each other with a first discharge gap in the discharge space and a second discharge cell including a portion where a light absorptive layer is provided on the front substrate's side and one row electrode of the row electrode pair and the other row electrode of the row electrode pair adjacent to the above row electrode pair are opposed to each other with a second discharge gap, the method comprising:

an address stage for producing an address discharge within the second discharge cell selectively by applying a pixel data pulse based on the pixel data, to the respective column electrodes, while applying a scanning pulse to a row electrode having the longer distance to the first discharge cell, of the respective row electrodes within the second discharge cell, thereby setting the second discharge cell at a light-on state or a light-off state;

a priming expansion stage for expanding a discharge toward the first discharge cell to set the first discharge cell at a light-on state, by applying a priming pulse alternately to the respective row electrodes within the second discharge cell to cause a priming discharge only in the second discharge cell that is in the light-on state; and a sustain stage for repeatedly applying a sustain pulse alternately to the respective row electrodes within the first discharge cell to cause a sustain discharge only in the first discharge cell that is in the light-on state.

17. The driving method of the display panel, according to claim 16, wherein the second discharge gap is formed at a position deviated from a medium position between the respective row electrodes within the second discharge cell toward the first discharge cell.

18. The driving method of the display panel, according to claim 16, wherein each of the row electrodes in pairs has a main body extending in a horizontal direction of the display panel and a protrudent portion protruding from the main body in a direction perpendicular to the horizontal direction in each unit-light emission area, the first discharge cell includes a portion where the protrudent portions of the respective row electrodes in pair are opposed to each other with the first gap within the discharge space, and the second discharge cell includes a portion where the protrudent portion of one row electrode of the row electrode pair is opposed to the protrudent portion of the other row electrode of the row electrode pair adjacent to the above row electrode pair with the second gap within the discharge space.

19. The driving method of the display panel, according to claim 16, wherein the discharge spaces of the respective second discharge cells adjacent in the horizontal direction of the display panel are blocked by each other and the discharge spaces of the respective first discharge cells adjacent in the horizontal direction of the display panel communicate with each other.

20. The driving method of the display panel, according to claim 16, wherein in the light-emission area, the first discharge cell is divided from the second discharge cell by a partition wall formed on an inner surface of the rear substrate and the discharge space of the first discharge cell communicates with the discharge space of the second discharge cell through an interstice between the partition wall and the front substrate.

21. The driving method of the display panel, according to claim 16, wherein a phosphor layer of emitting light by a discharge is formed only within the first discharge cell.

22. The driving method of the display panel, according to claim 16, wherein a second electron emissive layer is formed on the rear substrate within the second discharge cell.

23. The driving method of the display panel, according to claim 16, further comprising a reset stage for producing reset discharges within the second discharge cells of all the light-emission areas, prior to the address stage, by applying a reset pulse between the row electrode having the longer distance to the first discharge cell, of the respective row electrodes within the second discharge cell, and the column electrode, so as to make the column electrode at a lower potential.

24. The driving method of the display panel, according to claim 23, wherein in the reset stage, an odd row reset stage for producing the reset discharge within the respective second discharge cells belonging to odd display lines in the display panel and an even row reset stage for producing the reset discharge within the respective second discharge cells belonging to even display lines in the display panel are performed with time difference.

25. The driving method of the display panel, according to claim 16, wherein in the address stage, an odd row address stage for producing the address discharges within the respective second discharge cells belonging to the odd display lines in the display panel and an even row address stage for producing the address discharges within the respective second discharge cells belonging to the even display lines in the display panel are performed with time difference.

26. The driving method of the display panel, according to claim 16, wherein the reset pulse has a waveform of lower transition level than the sustain pulse, in rising and falling periods.

27. The driving method of the display panel, according to claim 23, wherein the reset pulse has a waveform of lower transition level than the sustain pulse, in rising and falling periods.

28. The driving method of the display panel, according to claim 16, comprising an erase stage for producing an erase discharge within the first discharge cell by applying an erase pulse to the respective row electrode pairs after completion of the sustain discharge in the sustain stage.

29. The driving method of the display panel, according to claim 16, comprising a charge transition stage for moving a wall discharge from the first discharge cell to the second discharge cell, by applying a charge transition pulse between one row electrode, of the respective row electrodes within the second discharge cell, and the other row electrode of the row electrode pair adjacent to the above row electrode after completion of the sustain discharge in the sustain stage, and discharging only the second discharge cell paired with the first discharge cell where the sustain discharge has been produced.

* * * * *